US011263960B2

(12) United States Patent
Xiong et al.

(10) Patent No.: US 11,263,960 B2
(45) Date of Patent: Mar. 1, 2022

(54) DISPLAY PANEL, DRIVING METHOD AND DISPLAY DEVICE

(71) Applicant: Shanghai Tianma AM-OLED Co., Ltd., Shanghai (CN)

(72) Inventors: Nana Xiong, Shanghai (CN); Jujian Fu, Shanghai (CN)

(73) Assignee: SHANGHAI TIANMA AM-OLED CO., LTD., Shanghai (CN)

( * ) Notice: Subject to any disclaimer, the term of this patent is extended or adjusted under 35 U.S.C. 154(b) by 0 days.

(21) Appl. No.: 17/016,188

(22) Filed: Sep. 9, 2020

(65) Prior Publication Data

US 2020/0410924 A1 Dec. 31, 2020

(30) Foreign Application Priority Data

May 29, 2020 (CN) ..... 202010479877.9

(51) Int. Cl.
*G09G 3/32* (2016.01)
*G09G 3/3233* (2016.01)

(52) U.S. Cl.
CPC ..... *G09G 3/32* (2013.01); *G09G 3/3233* (2013.01); *G09G 2310/0262* (2013.01);
(Continued)

(58) Field of Classification Search
CPC ..... G09G 3/32–3291; G09G 2300/0421–043; G09G 2300/0814; G09G 2310/0262; G09G 2310/0272; G09G 2310/0278; G09G 2310/0281; G09G 2310/0289; G09G 2310/0291;
(Continued)

(56) References Cited

U.S. PATENT DOCUMENTS

2006/0044232 A1* 3/2006 Choi ..... H01L 27/3244 345/76
2011/0031491 A1* 2/2011 Yamazaki ..... H01L 29/78696 257/43
(Continued)

FOREIGN PATENT DOCUMENTS

CN 104252836 A 12/2014
CN 106205490 A 12/2016
(Continued)

*Primary Examiner* — Nathan Danielsen
(74) *Attorney, Agent, or Firm* — Alston & Bird LLP

(57) ABSTRACT

Disclosed are a display panel and a driving method. The display panel includes: a substrate, sub-pixels and a switch module. Each sub-pixel includes a pixel drive circuit and a light-emitting element. The pixel drive circuit includes an initialization transistor and a drive transistor, each including a first electrode, a second electrode, and a gate electrode; the first electrode of the initialization transistor is electrically connected to the gate electrode of the drive transistor. The drive transistor provides a drive current to the light-emitting element, the second electrodes of the initialization transistors of at least two sub-pixels are connected to an output terminal of the same switch module. An input terminal of the switch module is electrically connected to an initialization signal terminal. The switch module transfers an initialization signal to the second electrode of the initialization transistor.

17 Claims, 14 Drawing Sheets

(52) U.S. Cl.
CPC ..... *G09G 2310/0272* (2013.01); *G09G 2310/0278* (2013.01); *G09G 2330/028* (2013.01)

(58) Field of Classification Search
CPC ..... G09G 2310/08; G09G 2320/02; G09G 2320/0219; G09G 2320/0223; G09G 2320/0233; G09G 2320/0242; G09G 2320/045; G09G 2330/028
See application file for complete search history.

(56) References Cited

U.S. PATENT DOCUMENTS

| | | | | |
|---|---|---|---|---|
| 2015/0001504 | A1* | 1/2015 | Kim | G09G 3/3233 257/40 |
| 2015/0168760 | A1* | 6/2015 | Sugiyama | H01L 27/1248 349/42 |
| 2016/0218155 | A1* | 7/2016 | Park | G09G 3/3233 |
| 2017/0039972 | A1* | 2/2017 | Li | G09G 3/3648 |
| 2018/0006263 | A1* | 1/2018 | Yoon | G09G 3/3233 |

FOREIGN PATENT DOCUMENTS

| | | | |
|---|---|---|---|
| CN | 106710529 | A | 5/2017 |
| CN | 110675816 | A | 1/2020 |

* cited by examiner

-- Prior Art--

DISPLAY PANEL, DRIVING METHOD AND DISPLAY DEVICE

CROSS-REFERENCE TO RELATED APPLICATIONS

This application claims the priority to Chinese patent application No. CN202010479877.9 filed with CNIPA on May 29, 2020, the disclosure of which is incorporated herein by reference in its entirety.

TECHNICAL FIELD

The present disclosure relates to the field of display technologies, and particularly, to a display panel, a driving method and a display device.

BACKGROUND

Currently, Organic Light-Emitting Diode (OLED) display panels and Liquid Crystal Display (LCD) display panels are two mainstream display panel technologies in the display field. OLED display panels are widely popular among people because of their advantages such as self-luminescence, high contrast, small thickness, high response speed, and applicability to flexible substrates.

The OLED element of an OLED display panel is a current driven element, and a corresponding pixel drive circuit is needed to provide a drive current for the OLED element, so that the OLED element can emit light. The pixel drive circuit of the OLED display panel generally includes a drive transistor, an initialization transistor, a storage capacitor, etc. The drive transistor can generate a drive current for driving the OLED element according to the voltage of a gate electrode of the drive transistor. The gate electrode of the drive transistor is electrically connected to the initialization transistor. The characteristics of these transistors are such that the charges on the gate electrode of the drive transistor continuously leak through the initialization transistor, so that the voltage of the gate electrode of the drive transistor is unstable, affecting the brightness of the light-emitting element, and eventually the display effect is affected.

SUMMARY

Embodiments of the present disclosure provide a display panel, a driving method, and a display device.

In a first aspect, an embodiment of the present disclosure provides a display panel. The display panel includes: a substrate; multiple sub-pixels located on one side of the substrate and arranged in an array; and at least one switch module. Each sub-pixel includes a pixel drive circuit and a light-emitting element; the pixel drive circuit includes an initialization transistor and a drive transistor, where the initialization transistor and the drive transistor each include a first electrode, a second electrode, and a gate electrode; the first electrode of the initialization transistor is electrically connected to the gate electrode of the drive transistor, and the drive transistor provides a drive current to the light-emitting element; the second electrodes of the initialization transistors of at least two sub-pixels are connected to an output terminal of a same switch module; an input terminal of the switch module is electrically connected to an initialization signal terminal; the switch module is used to transfer an initialization signal to the second electrode of the initialization transistor.

In a second aspect, an embodiment of the present disclosure further provides a driving method for a display panel. The driving method for the display panel is applied to the display panel according to the first aspect, and the driving method includes the following steps.

In an initialization phase, the initialization transistor and the switch module are turned on, and an initialization signal is written to a control terminal of the drive transistor.

In a light-emitting phase, the initialization transistor and the switch module are turned off, and the drive transistor drives the light-emitting element to emit light.

In a third aspect, an embodiment of the present disclosure further provides a display device. The display device includes the display panel of the first aspect.

BRIEF DESCRIPTION OF DRAWINGS

Other features, objects, and advantages of the present application will become more apparent by reading the detailed description of the non-limiting embodiments with reference to the following drawings.

DETAILED DESCRIPTION

In order to make the objectives, technical schemes and advantages of the present disclosure clearer, the technical schemes of the present disclosure will be described in detail through specific implementation manners in conjunction with the drawings in the embodiments of the present disclosure. Apparently, the described embodiments are a part of the embodiments of the present disclosure, but not all the embodiments. Based on the embodiments of the present disclosure, all other embodiments obtained by those of ordinary skill in the art without creative efforts, all fall within the protection scope of the present disclosure.

Figure 1:
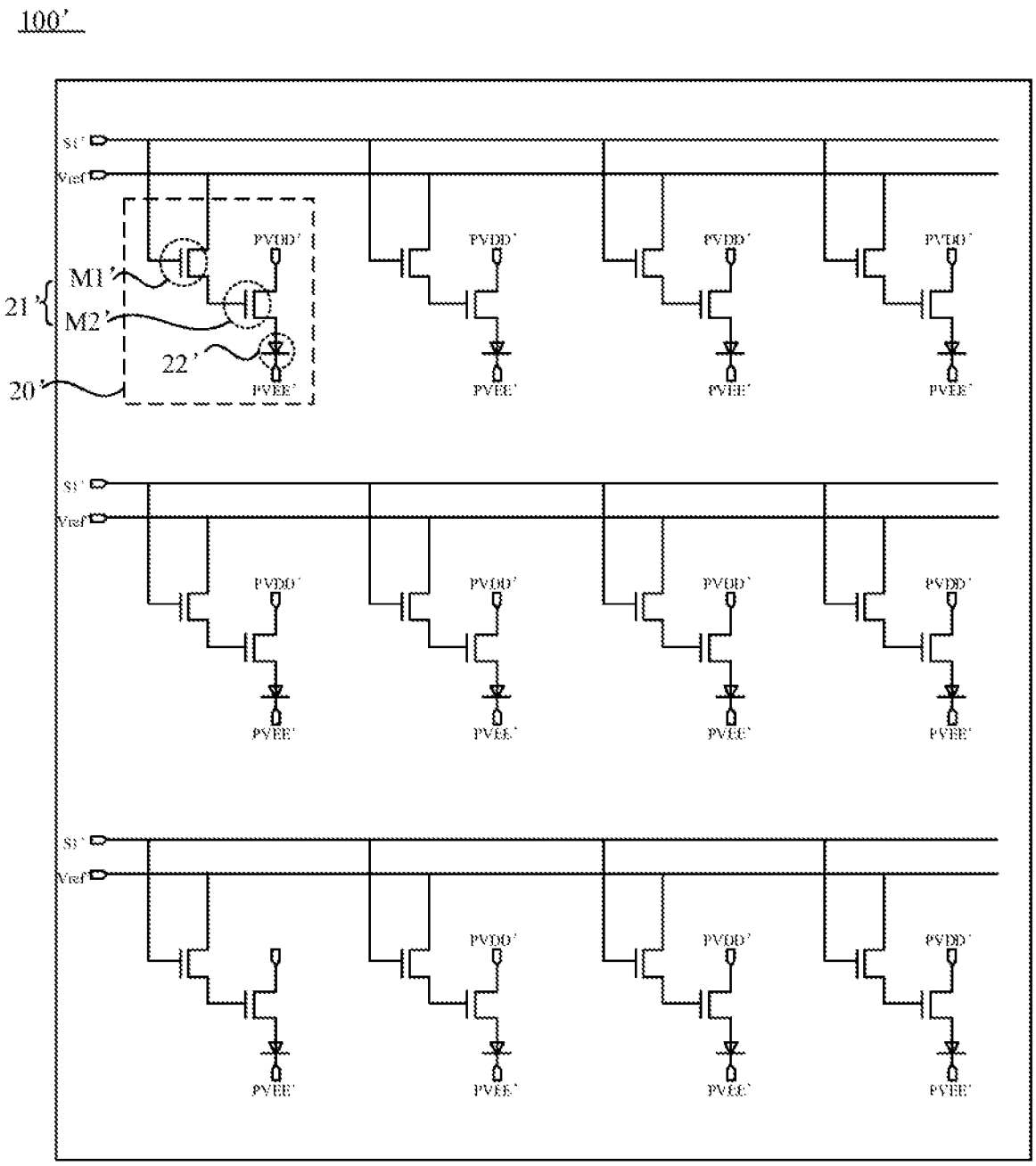
FIG. 1 is a schematic circuit diagram of a display panel provided in the related art.

FIG. 1 is a schematic circuit diagram of a display panel in the related art. As shown in FIG. 1, a display panel 100' in the related art includes multiple sub-pixels 20' arranged in an array; each sub-pixel 20' includes a pixel drive circuit 21' and the light-emitting element 22'; the pixel drive circuit 21' includes an initialization transistor M1' and a drive transistor M2'. A first electrode of the drive transistor M2' receives a first power supply voltage signal $V_{PVDD}$' during a light-emitting phase, a gate electrode of the drive transistor M2' is electrically connected to a second electrode of the initialization transistor M1', a second electrode of the drive transistor M2' is electrically connected to an anode of the light-emitting element 22', a cathode of the light-emitting element 22' receives a second power supply voltage signal $V_{VPEE}$' forming a current loop of the light-emitting element 22'. A first electrode of the initialization transistor M1' receives a Vref' signal, and when a gate electrode of the initialization transistor M1' receives the scan signal S1'. When the initialization transistor M1' is turned on, the Vref' signal is written to a gate electrode of the drive transistor M2', when the drive transistor M2' is initialized, and a voltage of the Vref' signal is kept at a lower voltage, for example, below −3.5V. However, when the initialization transistor M1' is turned off, the characteristics of the transistor makes the high potential of the gate electrode of the drive transistor M2' continuously leak toward the low potential, which causes the voltage at the gate electrode of the drive transistor M2' to be unstable, and finally affects the light-emitting brightness of the light-emitting device 22', and further affects the display effect.

In view of the above, an embodiment of the present disclosure provides a display panel, including: a substrate; multiple sub-pixels located on one side of the substrate; where the multiple sub-pixels are arranged in an array; each sub-pixel includes a pixel drive circuit and a light-emitting element; the pixel drive circuit includes an initialization transistor and a drive transistor, where the initialization transistor and the drive transistor each includes a first electrode, a second electrode, and a gate electrode; the first electrode of the initialization transistor is electrically connected to the gate electrode of the drive transistor, and the drive transistor is used to provide a drive current to the light-emitting element; and at least one switch module; where the second electrodes of the initialization transistors of at least two sub-pixels are connected to an output terminal of a same switch module; an input terminal of the switch module is electrically connected to an initialization signal terminal; the switch module is used to transfer an initialization signal to the second electrode of the initialization transistor. By adopting the above technical scheme, on one hand, the switch module is arranged between the initialization signal terminal and the initialization transistor, so that a voltage of the second electrode of the initialization transistor in the non-initialization phase is suspended, compared with the related art that the potential of the second electrode of the initialization transistor in the cut-off state is an initialization potential, the potential difference between the first electrode and the second electrode of the initialization transistor is reduced, and the electric leakage of the initialization transistor in the cut-off state is further alleviated; on the other hand, the initialization transistors of at least two sub-pixels and a switch module jointly form a leakage path, compared with the related art that the initialization transistor of each sub-pixel is a leakage path and multiple sub-pixels have multiple leakage paths, the number of the leakage paths of the sub-pixels is reduced, the magnitude order of leakage of a single sub-pixel in a display panel is reduced, the unstable voltage of the gate electrode of a drive transistor due to the leakage of the initialization transistor is further alleviated, and the display effect is improved.

The above is the core idea of the present disclosure. The technical schemes in the embodiments of the present disclosure will be described clearly and completely in conjunction with the drawings in the embodiments of the present disclosure. Based on embodiment of the present disclosure, all the other embodiments got by the technical personnel in this field on the premise of not paying creative labor, are in the scope of the protection of the present disclosure.

Figure 2:
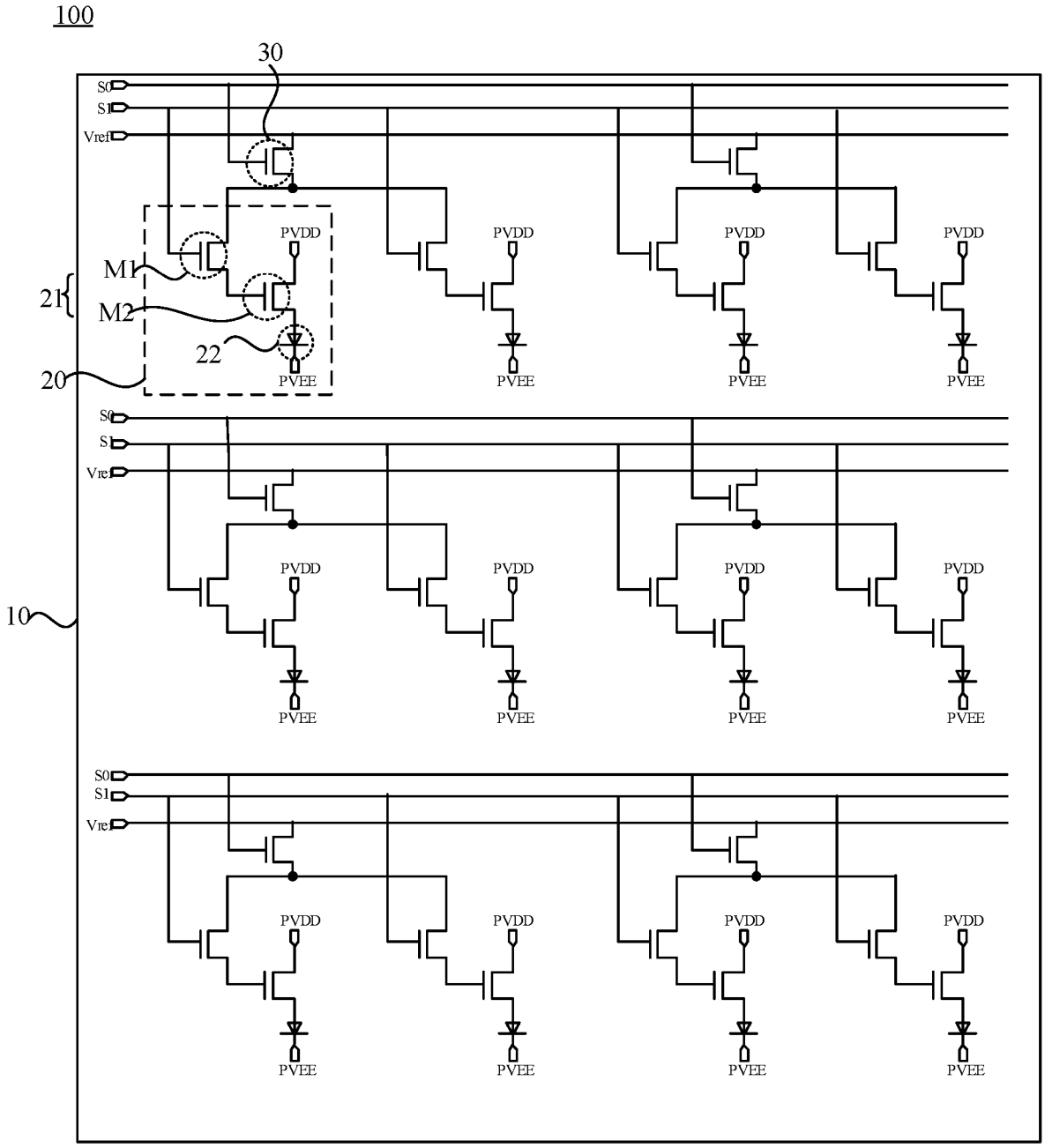
FIG. 2 is a schematic circuit diagram of a display panel according to an embodiment of the present disclosure.
Figure 3:
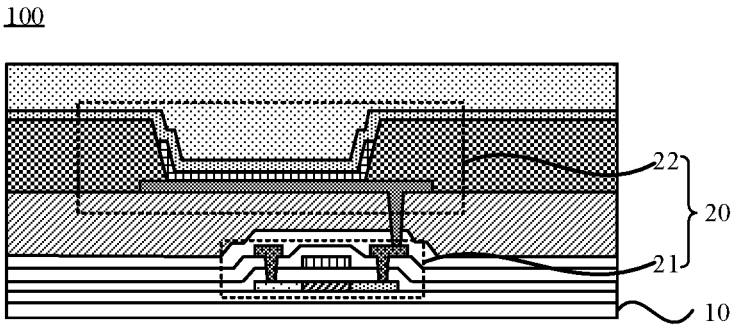
FIG. 3 is a schematic cross-sectional view of the structure of a display panel according to an embodiment of the present disclosure.

FIG. 2 is a schematic circuit diagram of a display panel according to an embodiment of the present disclosure, and FIG. 3 is a schematic cross-sectional view of a display panel according to an embodiment of the present disclosure. As shown in FIGS. 2 and 3, a display panel 100 provided by the embodiment of the present disclosure includes: a substrate 10, multiple sub-pixels 20 located on one side of the substrate 10, and also at least one switch module 30. The multiple sub-pixels 20 are arranged in an array; each sub-pixel 20 includes a pixel drive circuit 21 and a light-emitting element 22; the pixel drive circuit 21 includes an initialization transistor M1 and a drive transistor M2, where the initialization transistor M1 and the drive transistor M2 each include a first electrode, a second electrode, and a gate electrode; the first electrode of the initialization transistor M1 is electrically connected to the gate electrode of the drive transistor M2, and the drive transistor M2 is used to provide a driving current to the light-emitting element 22; the second electrodes of the initialization transistors M1 of at least two sub-pixels 20 are connected to the output terminal of a same switch module 30; an input terminal of the switch module 30 is electrically connected to an initialization signal terminal; the switch module 30 is used to transfer the initialization signal Vref to the second electrode of the initialization transistor M1.

Specifically, in an initialization phase, the switch module 30 and the initialization transistor M1 are turned on first, and the initialization transistor M1 provides an initialization signal Vref transferred through the switch module 30 to the gate electrode of the drive transistor M2 to initialize the drive transistor M2. Therefore, the influence on the display effect of the next frame is affected since the potential of the gate electrode of the drive transistor M2 is affected by the data signal of the previous frame for light-emitting display is avoided.

Specifically, in a light-emitting phase, the switch module 30 and the initialization transistor M1 are turned off, and a drive current generated by the drive transistor M2 flows into the light-emitting element 22, and the light-emitting element 22 emits light in response to the drive current. At this time, in the related art, the initialization transistor M1 is turned off, but the voltage of the gate electrode of the drive transistor M2 continuously leaks through the initialization transistor M1. The leakage is caused by a large potential difference between the first electrode of the initialization transistor M1 (which may also be understood as the gate electrode of the drive transistor M2) and the second electrode of the initialization transistor M1, that is, V1=Vdata−Vth−Vref, where V1 is a potential difference of the first electrode of the initialization transistor M1 and the second electrode of the initialization transistor M1, Vdata−Vth is a voltage of the gate electrode of the drive transistor M2, Vref is a voltage of the second electrode of the initializing transistor M1; the greater the potential difference is, the more serious the leakage is, and the more significantly the voltage of the gate electrode of the drive transistor M2 is affected, which in turn affects the light-emitting brightness of the light-emitting element 22. Based on this, in this embodiment, the switch module 30 is set between the initialization signal terminal and the initialization transistor M1, when both the switch module 30 and the initialization transistor M1 are in the off state, the voltage of the second electrode of the initialization transistor M1 is suspended. At this time, the potential difference between the first electrode of the initialization transistor M1 and the second electrode of the initialization transistor M1 is V2, V2=Vdata−Vth−V0, where Vdata−Vth is the voltage of the gate electrode of the drive transistor M2, and V0 is the voltage of the second electrode of the initialization transistor M1, and at this time V0 is about 0V. In this way, the potential difference between the first electrode of the initialization transistor M1 and the second electrode of the initialization transistor M1 changes from V1=Vdata−Vth−Vref in the related art to V2=Vdata−Vth−V0, where Vref is negative, for example, −3.5V, V0 is about 0 V, and V2<V1, the potential difference between the first electrode of the initialization transistor M1 and the second electrode of the initialization transistor M1 is reduced, and thereby the charge leakage of the initialization transistor M1 is alleviated. In addition, as mentioned above, the voltage of the gate electrode of the drive transistor M2 is unstable due to the continuous leakage of the initialization transistor M1. In the related art, the initialization transistor of each sub-pixel is a charge leakage path, and multiple sub-pixels have multiple leakage paths. However, in this embodiment, the first electrodes of the initialization transistors M1 of at least two sub-pixels 20 are connected to the same switch module 30, for the initialization transistors M1 and the switch module 30 connected in series, when the initialization transistors M1 and the switch module 30 are all in the off state, the potential at the connection between the initialization transistor M1 and the switch module 30 is suspended, then the at least two initialization transistors M1 and the switch module 30 together form a leakage path, thereby reducing the number of leakage paths. In addition, because of the limitation of the leakage of the switch module 30 connected in series, for the initialization transistors M1 connected to the switch module 30, the leakage of each initialization transistor M1 is reduced; that is, compared with the related art, the magnitude order of leakage of the multiple sub-pixels 20 in the display panel is reduced, the unstable voltage of the gate electrode of the drive transistor M2 due to the leakage of the initialization transistor M1 is further alleviated, and the display effect is improved.

It should be noted that only the initialization transistors M1 of two sub-pixels 20 and one switch module 30 are shown as an example for illustration in FIG. 2, but does not constitute a limitation of the present application, and those skilled in the art may set it according to actual conditions.

It should be noted that in this embodiment, the first electrode of the initialization transistor M1 is one of the source electrode and the drain electrode of the initialization transistor M1, and the second electrode of the initialization transistor M1 is the other of the source electrode and the drain electrode of the transistor M1. Similarly, in this embodiment, the first electrode of the drive transistor M2 is one of the source electrode and the drain electrode of the drive transistor M2, and the second electrode of the drive transistor M2 is the other one of the source electrode and the drain electrode of the drive transistor M2. The transistors in the following embodiments are the same, and are not repeated in the following embodiments.

In an embodiment, with continued reference to FIG. 2, the switch module 30 includes a third transistor; a first electrode of the third transistor is electrically connected to the initialization signal terminal, a second electrode of the third transistor is electrically connected to the second electrodes of the initialization transistors M1 of at least two sub-pixels 20; and a gate electrode of the third transistor is used to obtain a switch control signal S0.

The switch control signal S0 is used to control the third transistor to be turned on or off, thereby controlling whether the initialization signal Vref is transferred to the second electrode of the initialization transistor M1. The scan signal S1 is used to control the initialization transistor M1 to be turned on or off. In an embodiment, the scan signal S1 and the switch control signal S0 may be obtained through different signal lines, as shown in FIG. 2, or through a same signal line (not shown).

It should be noted that FIG. 2 only uses the switch module 30 including the third transistor as an example for illustration, but does not constitute a limitation on the present application, as long as the switch module is turned on during the initialization phase to write the initialization signal Vref to the second electrode of the initialization transistor M1 and is turned off in the light-emitting phase. The following embodiments also take the example in which the switch module 30 includes the third transistor as an example for illustration, but it does not constitute a limitation on the present application, and the following embodiments are not described in detail.

In an embodiment, the initialization transistor M1 includes an oxide transistor or a double gate electrode structure. In this way, the leakage current of the initialization transistor M1 in the off state may be further reduced.

Figure 4:
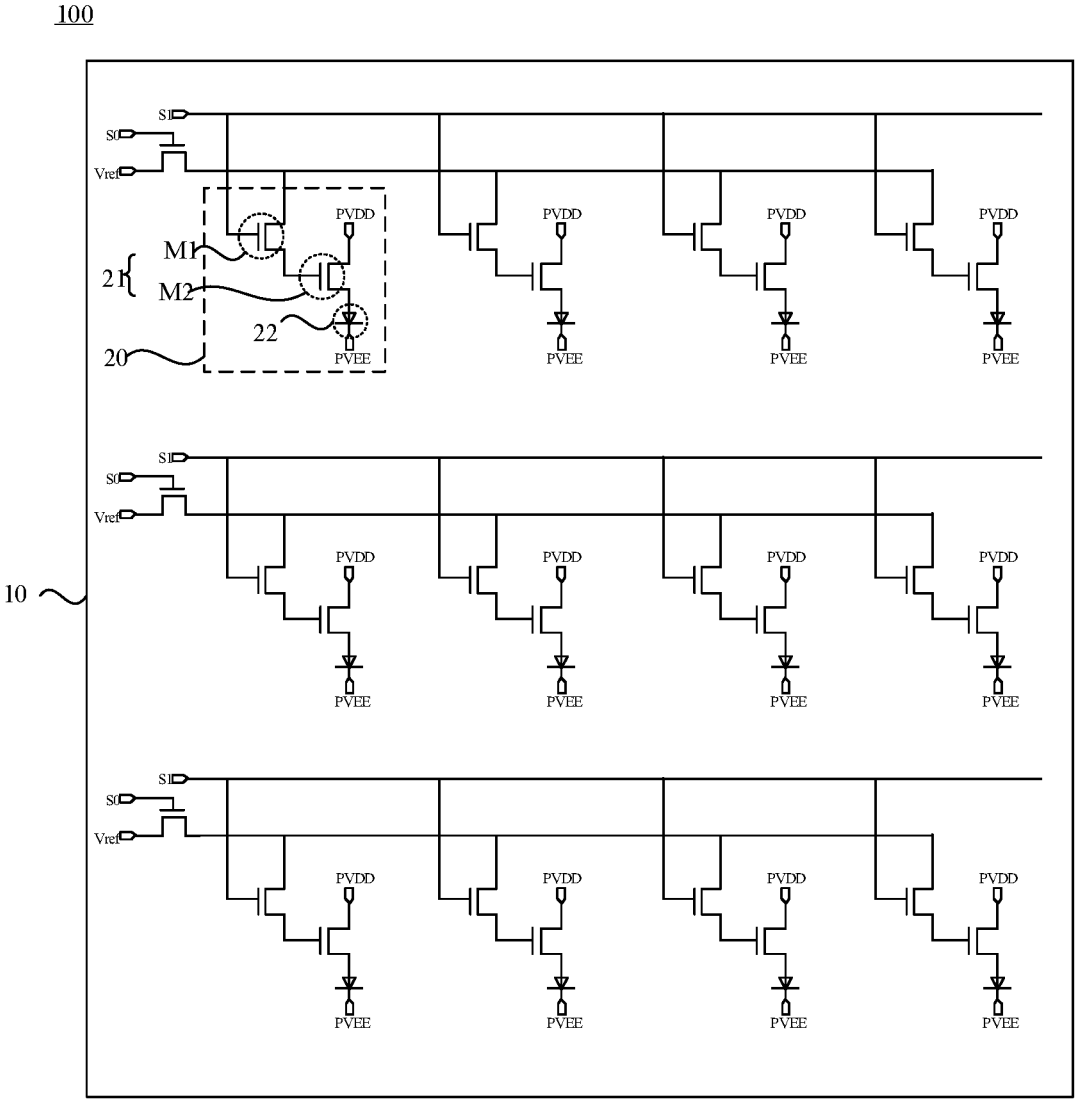
FIG. 4 is a schematic circuit diagram of another display panel according to an embodiment of the present disclosure.

In an embodiment, FIG. 4 is a schematic circuit diagram of another display panel according to an embodiment of the present disclosure. As shown in FIG. 4, the second electrodes of the initialization transistors M1 of the sub-pixels 20 in each row are connected to an output terminal of a same switch module 30.

Specifically, the second electrodes of the initialization transistors M1 of the sub-pixels 20 in each row is connected to the output terminal of the same switch module 30, that is, all initialization transistors M1 of sub-pixels 20 in the same row and a switch module 30 together form a leakage path, which further reduces the magnitude of the leakage of the sub-pixels 20 in a row. In addition, since the second electrodes of the initialization transistors M1 of the sub-pixels 20 in each row are connected to the output terminal of the same switch module 30, the initialization signal Vref is simultaneously transferred to the second electrodes of the initialization transistors M1 of the sub-pixels 20 in each row through one switch module 30 to initialize the drive transistors M2 of the sub-pixels 20 in a row through the initialization transistors M1, so that the synchronization of the initialization of the drive transistors M2 of the sub-pixels 20 in the row is ensured.

Similarly, when the second electrodes of the initialization transistors M1 of the sub-pixels 20 in each row are connected to the output terminal of the same switch module 30, the scan signal S1 and the switch control signal S0 may be obtained through different signal lines, as shown in FIG. 3, or through a same signal line (not shown).

In an embodiment, for the switch module 30 and the initialization transistor M1 of the sub-pixel connected to each other, the off state of the switch module 30 and the off state of the initialization transistor M1 of the sub-pixel overlap in time.

The advantage of this arrangement is that at any time, as long as the initialization transistor M1 of the sub-pixel is in the off state, the switch module 30 is also in the off state; this ensures that at any time, as long as the initialization transistor M1 is off, the voltage of the second electrode of the initialization transistor M1 is suspended, and the initialization transistors M1 of at least two sub-pixels 20 and a switch module 30 together form a leakage path, the leakage between the first electrode of the initialization transistor M1 and the second electrode of the initialization transistor M1 is reduced.

In an embodiment, with continued reference to FIG. 2, for the switch module 30 and the initialization transistor M1 of the sub-pixel 20 connected to each other, the gate electrode of the initialization transistor M1 of the sub-pixel 20 and the control terminal of the switch module 30 are electrically connected to different scan lines. Through different scan lines, the scan signal S1 is acquired to control the on or off of the initialization transistor M1, and the switch control signal S0 is acquired to control the on or off of the switch module 30.

Figure 5:
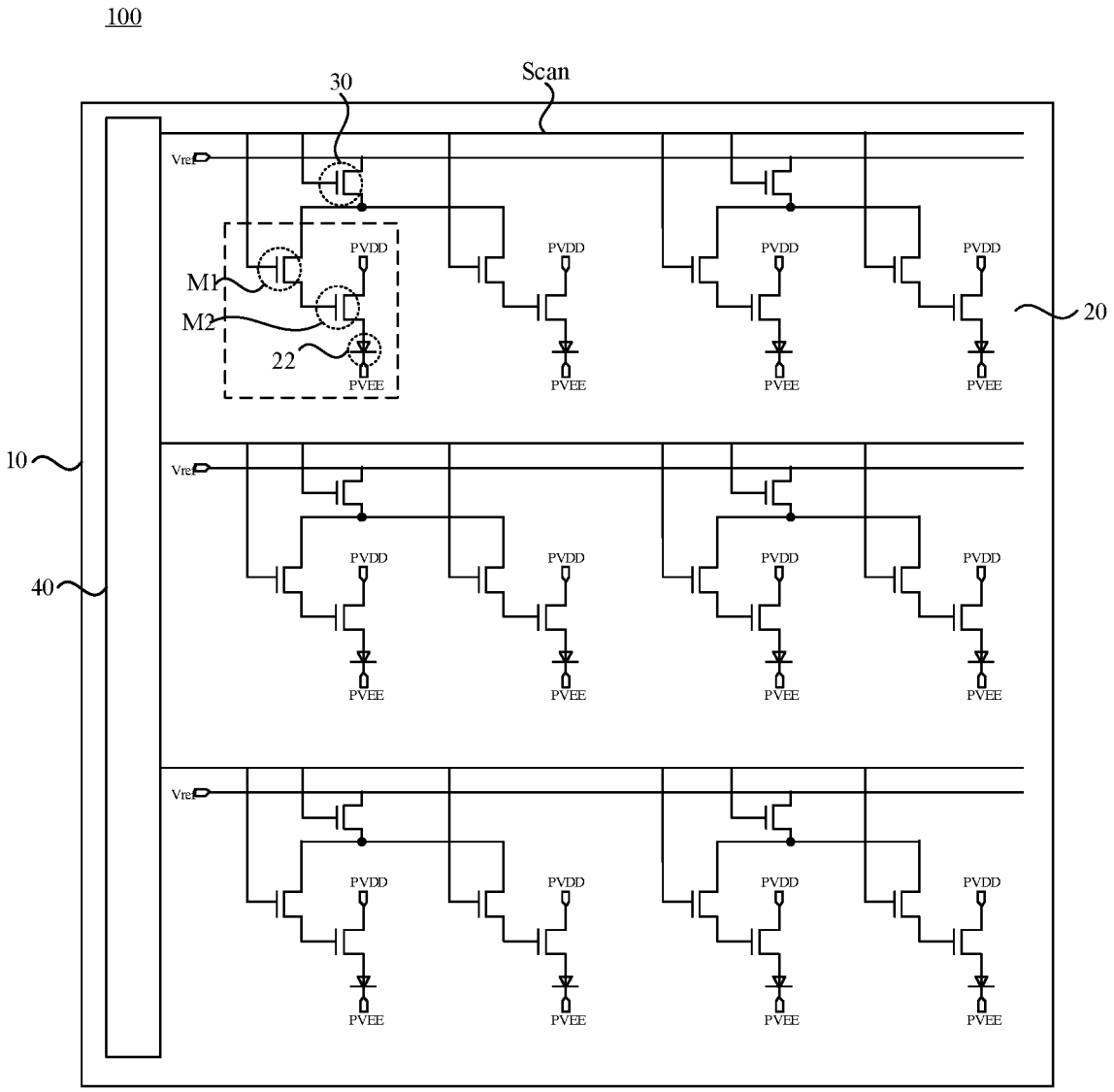
FIG. 5 is a schematic circuit diagram of another display panel according to an embodiment of the present disclosure.

FIG. 5 is a schematic circuit diagram of another display panel according to an embodiment of the present disclosure. As shown in FIG. 5, the display panel further includes: multiple scan lines Scan and a first scan drive circuit 40; signal output terminals of the first scan drive circuit 40 is electrically connected with the scan lines Scan in a one-to-one correspondence manner, and the first scan drive circuit 40 outputs a scan signal to a scan line Scan through a corresponding signal output terminal; where for the switch module 30 and the initialization transistor M1 of the sub-pixel 20 connected to each other, the gate electrode of the initialization transistor M1 of the sub-pixel 20 and the control terminal of the switch module 30 are electrically connected to a same scan line Scan.

Specifically, the first scan drive circuit 40 outputs a scan signal to a scan line Scan through a corresponding signal output terminal, and controls the on or off of the switch module 30 and the initialization transistor M1 of the sub-pixel 20 connected to each other through the same scan signal. There is no need to provide separate scan lines for the switch module 30 and the initialization transistor M1 of the sub-pixel 20 connected to each other. The advantage of this arrangement is that the structure is simple, and it is beneficial to reduce the number of control terminals on a chip for driving the pixel drive circuit 20 and save chip costs; in addition, the synchronization of the initialization of the drive transistor M2 of the sub-pixels 20 in a row and the off-state of the switch module 30 and the off-state of the initialization transistor M1 of the sub-pixel are ensured to overlap in time.

Figure 6:
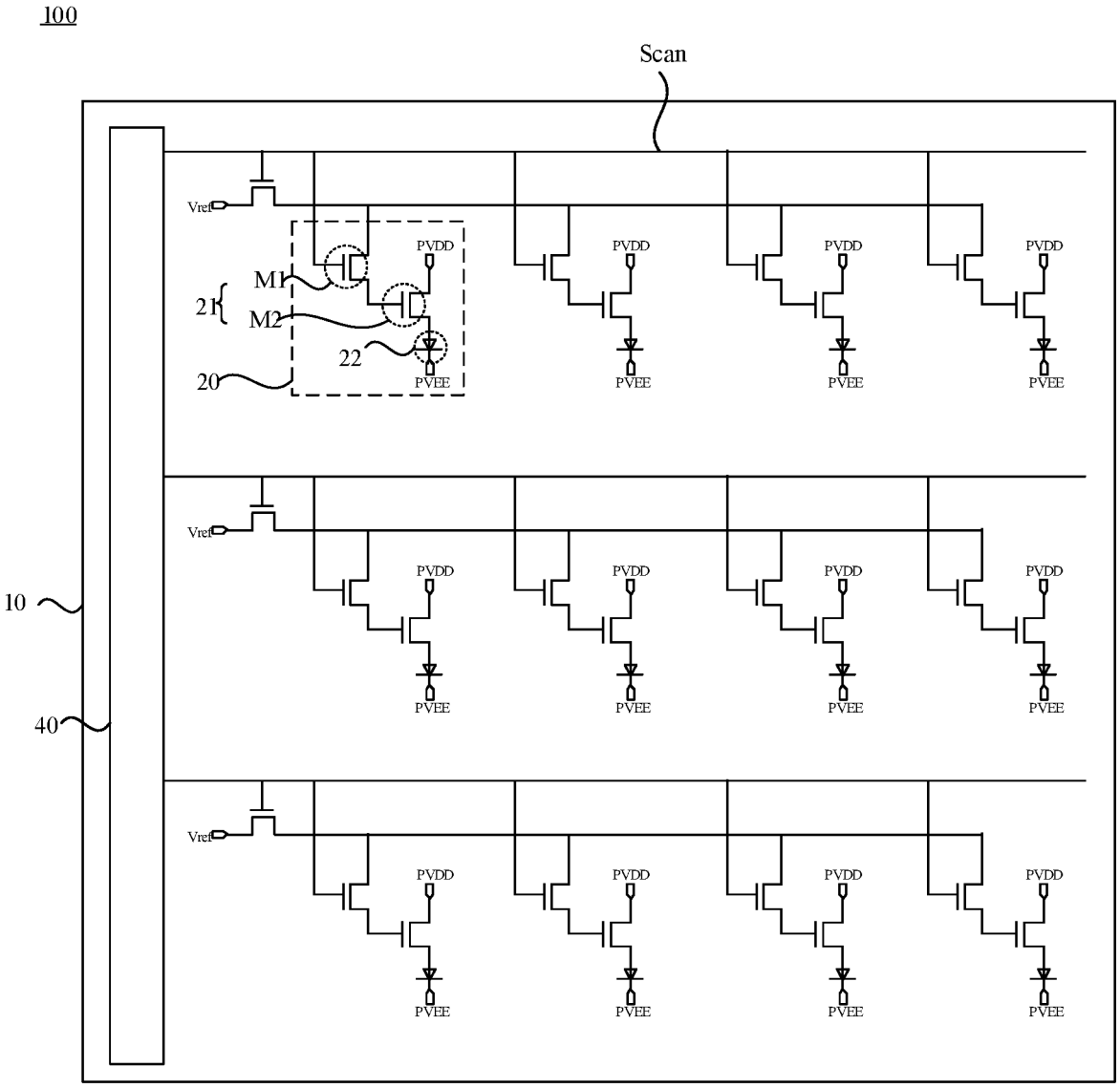
FIG. 6 is a schematic circuit diagram of another display panel according to an embodiment of the present disclosure.

FIG. 6 is a schematic circuit diagram of yet another display panel according to an embodiment of the present disclosure. As shown in FIG. 6, when the second electrodes of the initialization transistors M1 of the sub-pixels 20 in each row are connected to an output terminal of a same switch module 30, for the switch module 30 and the initialization transistors M1 of the sub-pixels 20 connected to each other, the gate electrodes of the initialization transistors M1 of the sub-pixels 20 and the control terminal of the switch module 30 are electrically connected to a same scan line Scan.

Figure 7:
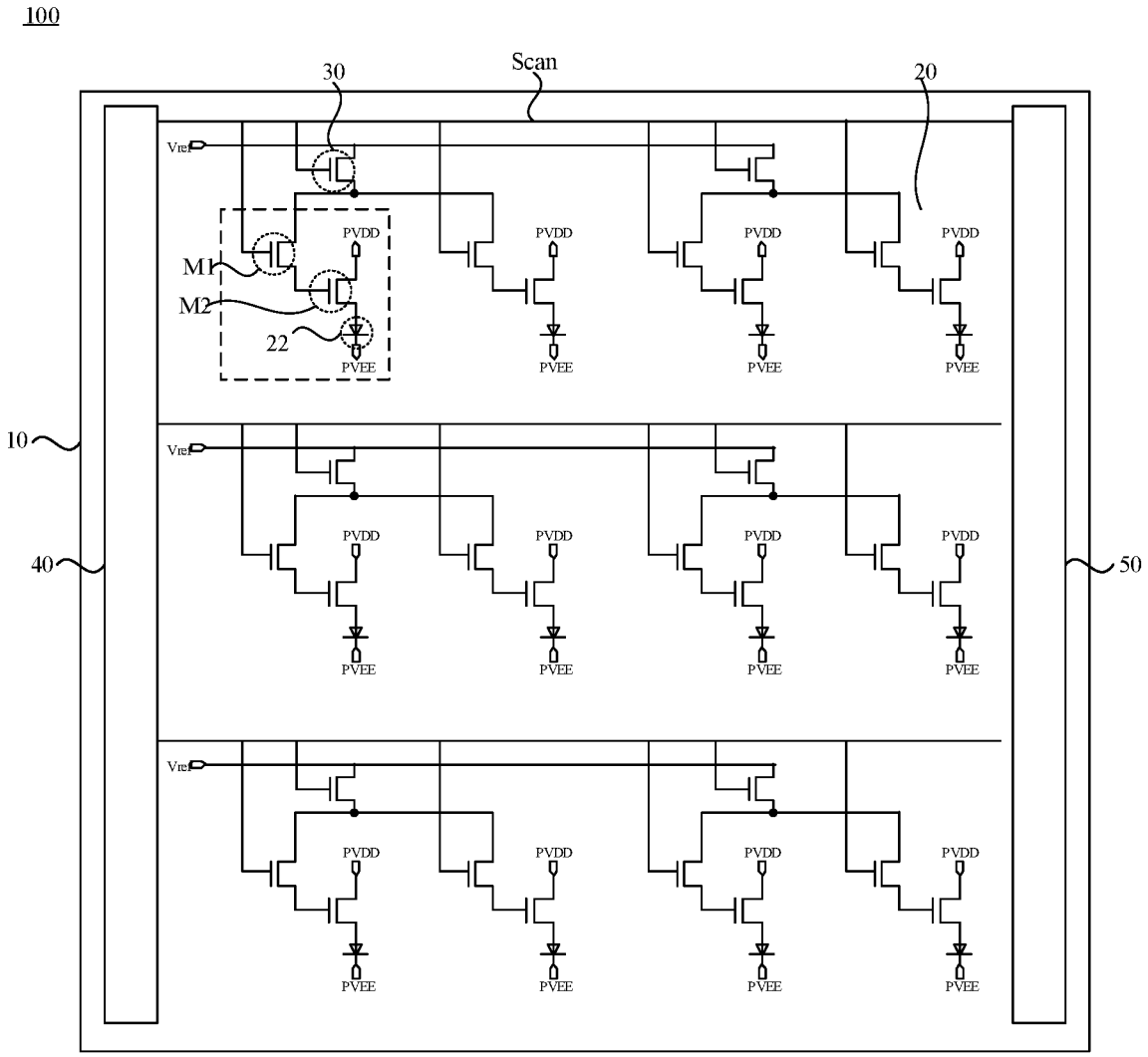
FIG. 7 is a schematic circuit diagram of another display panel according to an embodiment of the present disclosure.

FIG. 7 is a schematic circuit diagram of another display panel according to an embodiment of the present disclosure. As shown in FIG. 7, the display panel further includes: multiple scan lines Scans, a first scan drive circuit 40 and a second scan drive circuit 50; the signal output terminals of the first scan drive circuit 40 and the second scan drive circuit 50 are electrically connected through a scan lines Scan, and the first scan drive circuit 40 and the second scan drive circuit 50 connected with the same scan line Scan synchronously output scan signals to the scan line Scan through the signal output terminals; where for the switch module 30 and the initialization transistors M1 of the sub-pixels 20 connected to each other, the gate electrode of the initialization transistors M1 of the sub-pixels 20 and the control terminal of the switch module 30 are electrically connected to the same scan line Scan.

Specifically, by providing the first scan drive circuit 40 and the second scan drive circuit 50, the signal output terminals of the first scan drive circuit 40 and the second scan drive circuit 50 are electrically connected to the same scan line Scan, the first scan drive circuit 40 and the second scan drive circuit 50 connected with the same scan line Scan synchronously output scan signals to the scan line Scan through the signal output terminals, and the synchronously output scan signals control the on and off of the switch module 30 and the initialization transistors M1 of the sub-pixels 20 connected to each other, so as to avoid the influence of the voltage drop on the scan line Scan affects the on and off of the initialization transistors M1 and the switch module 30.

Figure 8:
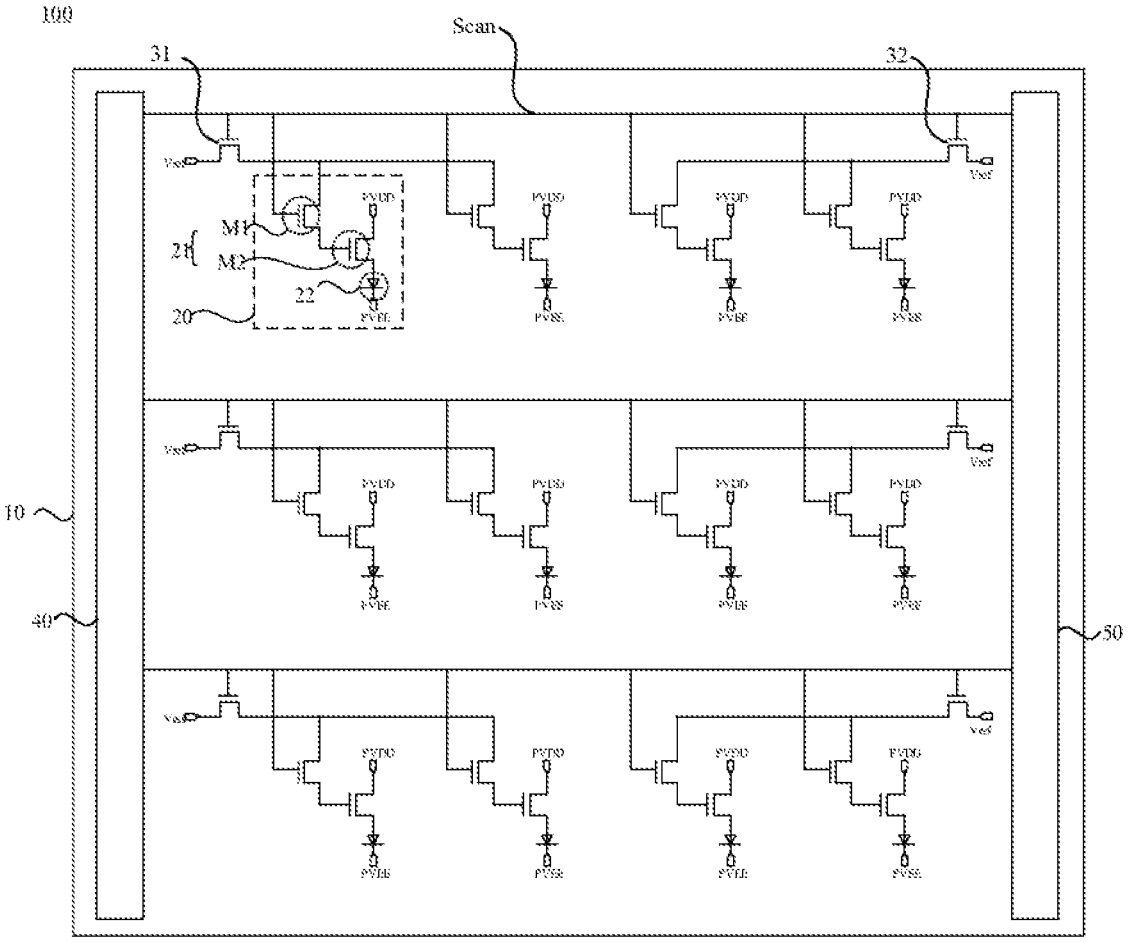
FIG. 8 is a schematic circuit diagram of yet another display panel according to an embodiment of the present disclosure.

FIG. 8 is a schematic circuit diagram of yet another display panel according to an embodiment of the present disclosure. As shown in FIG. 8, the display panel further includes: multiple scan lines Scans, a first scan drive circuit 40, and a second scan drive circuit 50; the signal output terminals of the first scan drive circuit 40 and the second scan drive circuit 50 are electrically connected through a scan line Scan, and the first scan drive circuit 40 and the second scan drive circuit 50 electrically connected to the same scan line synchronously output scan signals to the scan line Scan through the signal output terminals; the switch module 30 includes a first switch unit 31 and a second switch unit 32; the number of sub-pixels 20 in each row is M; an output terminal of the first switch unit 31 is electrically connected to the second electrodes of the initialization transistors M1 of the N sub-pixels 20 in each row; an output terminal of the second switch unit 32 is electrically connected to the second electrodes of the initialization transistors M1 of the remaining (M−N) sub-pixels 20 in each row; where for the first switch unit 31 and the initialization transistors M1 of the N sub-pixels 20 connected to each other, the first switch unit 31 is connected to the gate electrodes of the initializing transistors M1 of the N sub-pixels 20; for the second switch unit 32 and the initialization transistors M1 of the (M−N) sub-pixels connected to each other, a control terminal of the second switch unit 32 and the gate electrodes of the initialization transistors M1 of the (M−N) sub-pixels 20 are electrically connected to a same scan line Scan; the output terminal of the switch module 30 includes the output terminal of the first switch unit 31 and the output terminal of the second switch unit 32; M and N are positive integers, and N is less than M.

Specifically, by providing the first scan drive circuit 40 and the second scan drive circuit 50, the signal output terminals of the first scan drive circuit 40 and the second scan drive circuit 50 are electrically connected to the same scan line Scan, and the first scan drive circuit 40 and the second scan drive circuit 50 connected with the same scan line Scan synchronously output scan signals to the scan line Scan through the signal output terminals, and the synchronous output scan signals control the on and off of the first switch unit 31 and the initialization transistors M1 of the N sub-pixels 20 connected to each other, and the second switch unit 32 and the initialization transistors M1 of the (M-N) sub-pixels 20 connected to each other, so as to avoid the influence of the voltage drop on the scan line Scan affects the on and off of the initialization transistor M1 and the switch module 30.

Specifically, by providing the first switch unit 31 and the second switch unit 32 respectively, initialization signals are provided to the initialization transistors M1 of the sub-pixels 20 in a row from both sides of sub-pixels 20 of the row, so as to avoid the influence of the voltage drop on the scan line Scan affects the initialization of each sub-pixel 20.

Figure 9:
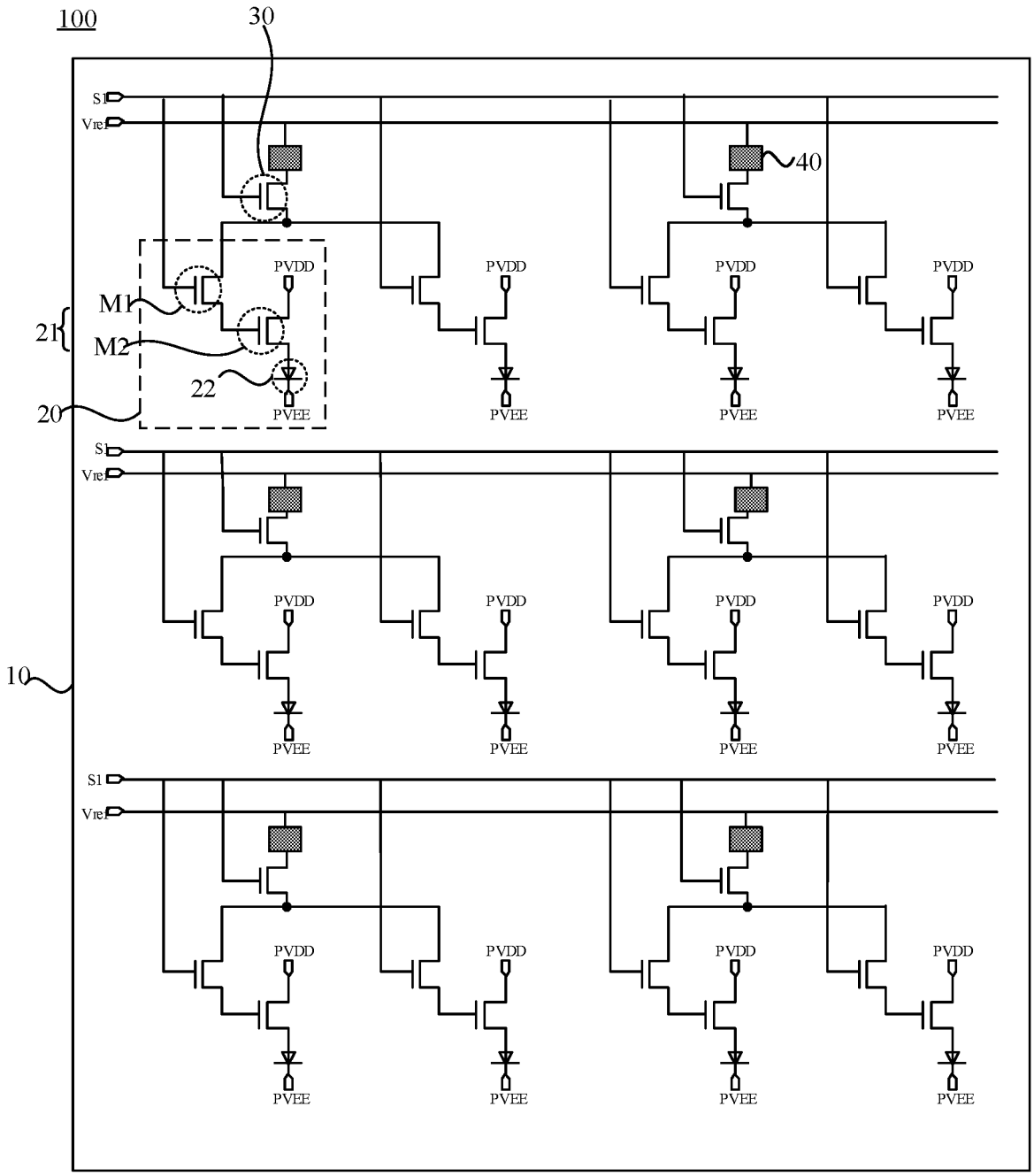
FIG. 9 is a schematic circuit diagram of yet another display panel according to an embodiment of the present disclosure.
Figure 10:
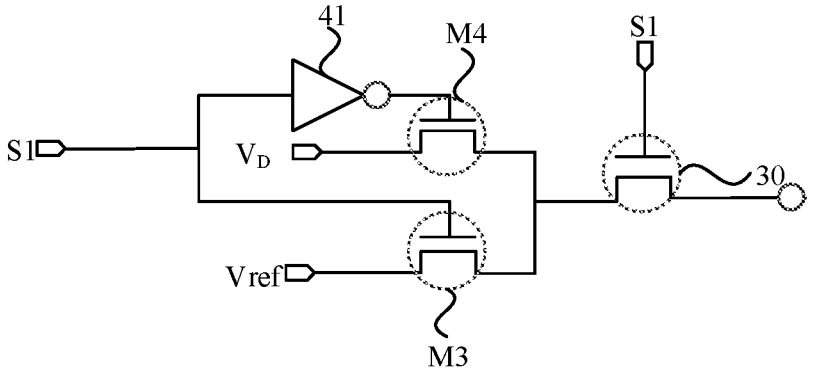
FIG. 10 is a schematic diagram of a gating module and a switch module according to an embodiment of the present disclosure.

FIG. 9 is a schematic circuit diagram of yet another display panel according to an embodiment of the present disclosure, and FIG. 10 is a schematic circuit diagram of a gating module and a switch module according to an embodiment of the present disclosure. As shown in FIGS. 9 and 10, the display panel 100 further includes: at least one gating module 40; the gating module 40 includes an inverter 41, a first transistor M3 and a second transistor M4; an output terminal of the inverter 41 is electrically connected to a gate electrode of the second transistor M4; a first electrode of the first transistor M3 is used to obtain a initialization potential Vref; a first electrode of the second transistor M4 is used to obtain a fixed potential $V_D$; a second electrode of the first transistor M3 and a second electrode of the second transistor M4 are electrically connected to the input terminal of the switch module 30; the fixed potential $V_D$ and the initialization potential Vref satisfy: $|V_D-Vdata|<|Vref-Vdata|$; where Vdata is the data signal potential of the sub-pixel 20; a signal received at the gate electrode of the first transistor M3 is the same as a signal at the input terminal of the inverter 41.

Specifically, in an initialization phase, the first transistor M3, the switch module 30 and the initialization transistor M1 are turned on, and the initialization transistor M1 provides an initialization signal to the drive transistor M2 to initialize the drive transistor M2. Therefore, the influence on the display effect of the next frame since the potential of the gate electrode of the drive transistor M2 is affected by the data signal of the previous frame for light-emitting display is avoided.

Specifically, in a light-emitting phase, a drive current generated by the drive transistor M2 flows into the light-emitting element 22, and the light-emitting element 22 emits light in response to the drive current. At this time, since the first transistor M3, the initialization transistor M1 and the switch module 30 are turned off, and the second transistor M4 is turned on, the voltage at the input terminal of the switch module 30 changes from Vref to a fixed potential $V_D$, the potential difference between the input terminal and the output terminal of the switch module 30 changes from $V0-V_D$ to V0−Vref, where $|V_D-Vdata|<|Vref-Vdata|$; V0 is the voltage of the second electrode of the initialization transistor M1, namely the voltage of the input terminal of the switch module 30, the voltage value at this time is about 0V. The leakage current of the switch module 30 is reduced, that is, the potential difference between the first electrode and the second electrode of the initialization transistor M1 is reduced, that is, on the basis of reducing the leakage current of the initialization transistor M1, the leakage current of the switch module 30 is reduced, and the stability of the voltage of the gate electrode of the drive transistor M2 is further improved, so that the current flowing through the light-emitting element 40 is stable, and the light-emitting element 40 has stable light-emitting brightness.

On the basis of the above scheme, in an embodiment, the fixed potential $V_D$ is ground potential.

The advantage of this arrangement is that, on one hand, the ground potential is less than Vref, which ensures that the potential difference between the input terminal and the output terminal of the switch module 30 is small; on the other hand, the ground potential can be obtained from the structure in the display panel, for example, a static shielding, there is no need to provide the ground potential separately, and the process steps are simplified.

In an embodiment, since the signal received at the gate electrode of the first transistor M3 is the same as the signal at the input terminal of the inverter 41, the signal may be obtained through the same signal line as shown in FIG. 9 or through different signal lines (not shown).

In addition, when the display panel 100 further includes at least one gating module 40, the beneficial effect of the way of providing the scan driving circuit is the same as the beneficial effect of setting the switch module 30, and in order to avoid repetition, they are not shown here.

Figure 11:
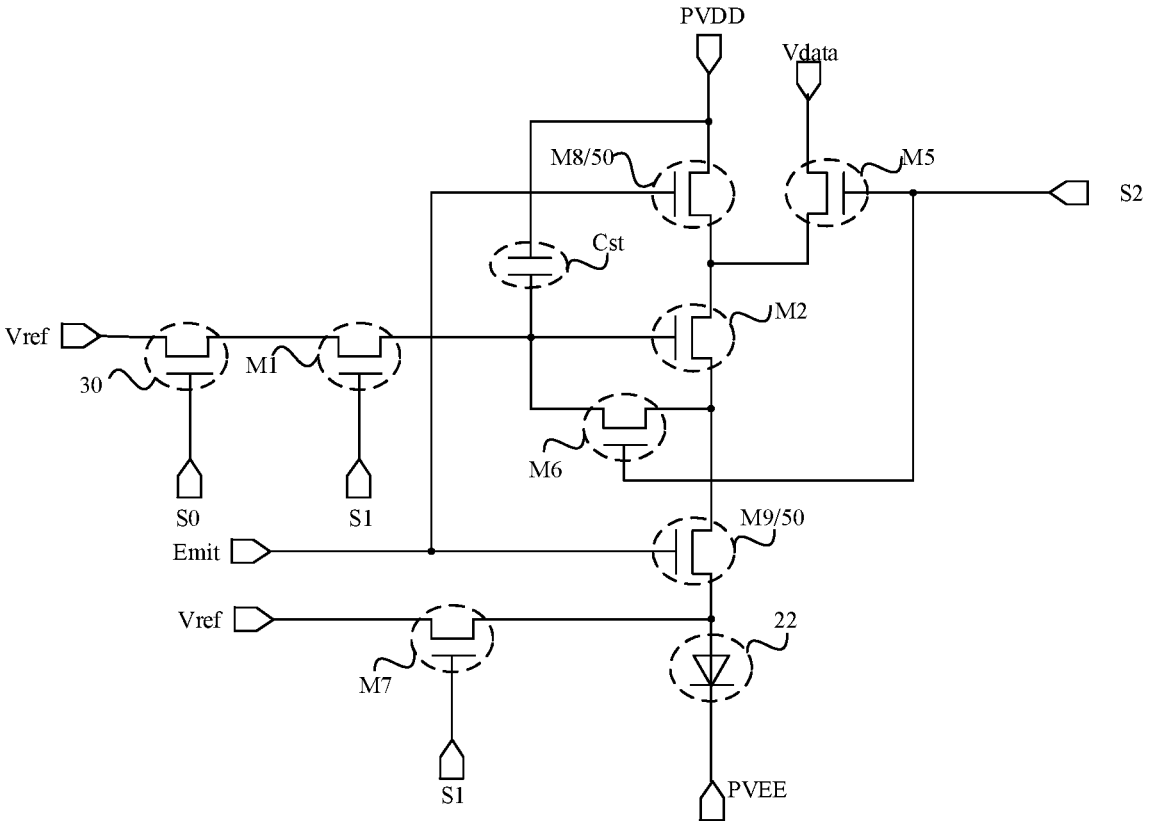
FIG. 11 is a schematic circuit diagram of a pixel drive circuit according to an embodiment of the present disclosure.

FIG. 11 is a schematic circuit diagram of a pixel drive circuit according to an embodiment of the present disclosure. As shown in FIG. 11, the pixel drive circuit further includes a data write transistor M5, a threshold compensation transistor M6, a light-emitting control module 50, and a memory capacitor Cst, a reset transistor M7; the data write transistor M5 is used to transfer a data signal; the threshold compensation transistor M6 is used to compensate the gate electrode of the drive transistor M2 with the threshold voltage of the drive transistor M2; the light-emitting control module 50 is used to control the drive transistor M2 to generate a drive current to flow into the light-emitting element 22; the reset transistor M7 is used to provide an initialization signal Vref to the anode of the light-emitting element 22; the light-emitting control module 50 includes a first light-emitting control transistor M8 and a second light-emitting control transistor M9; the gate electrode of the data write transistor M5 is electrically connected to the second scan signal terminal, the first electrode of the data write transistor M5 is electrically connected to the data signal terminal, the second electrode of the data write transistor M5 is electrically connected to the first electrode of the drive transistor M2; the gate electrode of the threshold compensation transistor M6 is electrically connected to the second scan signal terminal, the first electrode of the threshold compensation transistor M6 is electrically connected to the second electrode of the drive transistor M2, and the second electrode of the threshold compensation transistor M6 is electrically connected to the gate electrode of the drive transistor M2; the gate electrode of the first light-emitting control transistor M8 is electrically connected to the light-emitting control signal terminal, the first electrode of the first light-emitting control transistor M8 is electrically connected to the first power supply signal terminal, and the second electrode of the first light-emitting control transistor M8 is electrically connected to the first electrode of the drive transistor M2; the gate electrode of the second light-emitting control transistor M9 is electrically connected to the light-emitting control signal terminal, the first electrode of the second light-emitting control transistor M9 is electrically connected to the second electrode of the drive transistor M2, a second electrode of the second light-emitting control transistor M9 is electrically connected to the anode of the light-emitting element 22, and the cathode of the light-emitting element 22 is electrically connected to the second power signal terminal. The second power signal terminal provides a second power signal voltage $V_{VPEE}$ for forming a current loop of the light-emitting element 22.

It should be noted that FIG. 11 shows an example in which the pixel drive circuit 21 (not shown in FIG. 11) is a circuit having 7T1C (7 transistors and 1 storage capacitor), but the pixel drive circuit 21 is not limited to the arrangement of such a drive circuit as long as the drive of the pixel can be realized.

Each transistor may be a P-type transistor or an N-type transistor, which is not limited in the embodiment of the present disclosure. The following takes the pixel drive circuit 21 as 7T1C (7 transistors and 1 storage capacitor) as an example. The operating principle of the switch module 30 and the pixel drive circuit 21 is specifically described by taking the transistors and the switch module 30 as P-type transistors.

Figure 12:
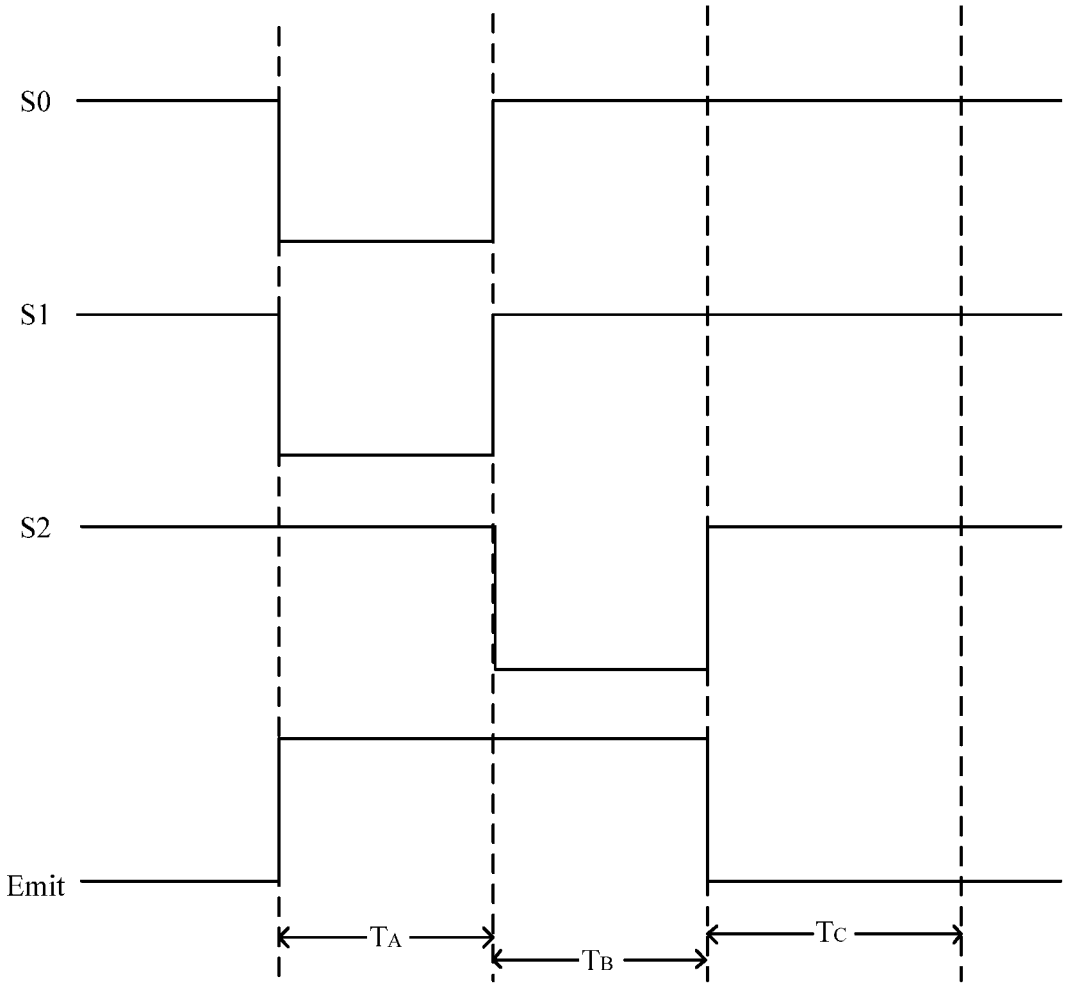
FIG. 12 is a drive timing sequence of a pixel drive circuit and a switch module according to an embodiment of the present disclosure.

FIG. 12 is a driving timing sequence of a pixel drive circuit and a switch module according to an embodiment of the present disclosure. During a period $T_A$, i.e., the initialization phase, the switch control signal S0 obtained by the control terminal of the switch module 30 is low, the scan signal S1 obtained by the gate electrode of the initialization transistor M2 and the scan signal S1 obtained by the gate electrode of the reset transistor M7 are low. At this time, the switch module 30, the initialization transistor M1, and the reset transistor M7 are turned on. However, the scan signal S2 provided by the second scan signal terminal and the light-emitting control signal Emit provided at the light-emitting control signal terminal are high, so that the data write transistor M5, the first light-emitting control transistor M8, the second light-emitting control transistor M9, and both the drive transistor M2 and the threshold compensation transistor M6 are turned off. An initialization signal Vref at the initialization signal terminal is written into the gate electrode of the drive transistor M2 through the turned-on switch module 30 and the turned-on initialization transistor M1 to initialize the gate electrode of the drive transistor M2, where the initialization signal Vref provided by the initialization signal terminal is a low-level signal to ensure that the drive transistor M2 can be turned on in a next phase. The initialization signal Vref at the initialization signal terminal is also written into the anode of the light-emitting element 22 through the turned-on reset transistor M7 to initialize the anode potential of the light-emitting element 22 and reduce the influence of the voltage of the anode of the light-emitting element 22 of the previous frame on the voltage of the anode of the light-emitting element 22 of the following frame, and improve the uniformity of display.

During a period $T_B$, i.e., the data signal voltage writing phase, the switch control signal S0 obtained by the control terminal of the switch module 30 is high, and the scan signal S1 obtained by the gate electrode of the initialization transistor M1 and the gate electrode of the reset transistor M7 is high. The light-emitting control signal Emit provided by the light-emitting control signal terminal is high. At this time, the switch module 30, the initialization transistor M1, the first light-emitting control transistor M8, the second light-emitting control transistor M9, and the reset transistor M7 are all turned off. However, the scan signal S2 provided by the second scan signal terminal is low. At this time, the data signal writing transistor M5 and the threshold compensation transistor M6 are turned on. At the same time, the potential of the gate electrode of the drive transistor M2 is the reference voltage Vref, which is also low, and the drive transistor M2 is also turned on. A data signal Vdata on the data signal terminal is written to the gate electrode of the drive transistor M2 through the data write transistor M5, the drive transistor M2, and the threshold compensation transistor M6, and the potential of the gate electrode of the drive transistor M2 gradually increases. Until the voltage difference between the voltage of the gate electrode of the drive transistor M2 and the first electrode of the drive transistor M2 is equal to the threshold voltage Vth of the drive transistor M2, the drive transistor M2 will be in the off state. Since the potential of the first electrode of the drive transistor M2 stays at Vdata, when the drive transistor M2 is turned off, the potential of the gate electrode G3 of the drive transistor M2 is Vdata−|Vth|, where Vdata is the data signal voltage provided by the data signal terminal, Vth is the threshold voltage of the drive transistor M2. At this time, the voltage difference Vc between the first electrode and the second plate of the storage capacitor Cst is: $Vc=V1-V2=V_{PVDD}-(Vdata-|Vth|)$, where V1 represents the potential of the first electrode of the storage capacitor Cst, and V2 represents the potential of the second electrode of the storage capacitor Cst, where $V_{PVDD}$ is the power signal voltage value of the first power signal terminal.

In the data signal voltage writing phase, the voltage difference Vc of the first and second electrodes of the storage capacitor Cst includes the threshold voltage Vth of the drive transistor M2, that is, in the data signal voltage writing phase, the threshold voltage Vth of the drive transistor M2 is detected and stored in the storage capacitor Cst.

During a period $T_C$, that is the light-emitting phase, the light-emitting control signal Emit provided by the light-emitting control signal terminal is a low-level signal, so that both the first light-emitting control transistor M8 and the second light-emitting control transistor M9 are turned on. A switch control signal S0 obtained by the control terminal of the switch module 30 is high, a scan signal S1 obtained by the gate electrode of the initialization transistor M1 and the gate electrode of the reset transistor M7 is high, and a scan signal S2 provided by the second scan signal terminal is low, so that the switch module 30, the initialization transistor M1, the reset transistor M7, and the threshold compensation transistor M6 and the data write transistor M5 are turned off. A power signal voltage $V_{PVDD}$ of the first power signal terminal is written into the first electrode of the drive transistor M2 through the turned-on first light-emitting control transistor M8. At this time, the voltage difference between the first electrode of the drive transistor M2 and the gate electrode of the drive transistor M2 is: $Vsg=V_{PVDD}-Vdata+|Vth|$, the drive transistor M2 generates a drive current, the drive current flows into the light-emitting element 22 through the second light-emitting control transistor M9, and the drive light-emitting element 22 emits light. The leakage current Id of the drive transistor M2 satisfies the following formula: the drive current Id is:

$$I_d = \frac{1}{2}\mu C_{ox}\frac{W}{L}(V_{sg} - |V_{th}|)^2 = \frac{1}{2}\mu C_{ox}\frac{W}{L}(V_{PVDD} - V_{date} + |V_{th}| - |V_{th}|)^2 = \frac{1}{2}\mu C_{ox}\frac{W}{L}(V_{PVDD} - V_{data})^2$$

where μ is the carrier mobility, $C_{OX}$ is the channel capacitance per unit area of the drive transistor M2, and W/L is the width-to-length ratio of the drive transistor M2. In this way, it can be seen that the drive current Id generated by the drive transistor M2 is independent of the threshold voltage Vth of the drive transistor M2. The threshold voltage of the drive transistor M2 is compensated, and the abnormal display caused by the threshold voltage drift of the drive transistor M2 is solved. In this phase, due to the presence of the switch module 30, the potential difference between the first and second electrodes of the initialization transistor M1 changes from the original Vdata−Vth−Vref to Vdata−Vth−V0, where V0 is the voltage of the second electrode of the initialization transistor M1, and the voltage value at this time is about 0V, the path of leakage through the initialization transistor M1 is reduced, the unstable voltage of the gate electrode of the drive transistor M2 due to the leakage of the initialization transistor M1 and the light-emitting brightness of the light-emitting element 22 is affected is further alleviated.

It should be noted that the switch control signal S0 acquired by the control terminal of the switch module 30 may be the same as the scan signal S1 obtained by the gate electrode of the initialization transistor M1, that is, the control terminal of the switch module 30 and the gate electrode of the initialization transistor M1 are connected to the same signal line, so that the structure is simple; the control terminal of the switch module 30 and the gate electrode of the initialization transistor M1 may be set separately, i.e., the switch control signal S0 and the scan signal S1 are separately obtained, at this time, it is necessary to ensure that the switch module 30 and the initialization transistor M1 are turned off at the same time during the light-emitting phase.

In an embodiment, the threshold compensation transistor M6 includes an oxide crystal, which can reduce the leakage current when the threshold compensation transistor M6 is turned off. The threshold compensation transistor M6 may also be a multi-gate structure, such as a double-gate structure. In this way, when the light-emitting element 22 emits light, it is beneficial to reduce the interference of the leakage current of the threshold compensation transistor M6 on the drive transistor M2, so as to avoid the influence on the drive current of the drive transistor M2 to drive the light-emitting element 22, and thereby it is beneficial to improve the control accuracy of the light-emitting brightness of the light-emitting element 22.

Considering that when the voltage of the second electrode of the initialization crystal M1 is suspended, it may be affected by other signals, so this application will improve the structure to reduce the influence of other signals on the voltage of the second electrode of the initialization crystal M1 when the voltage at the second electrode of the initialization crystal M1 is suspended. Several possible implementations are described below as examples, but are not intended to limit the present application.

Figure 13:
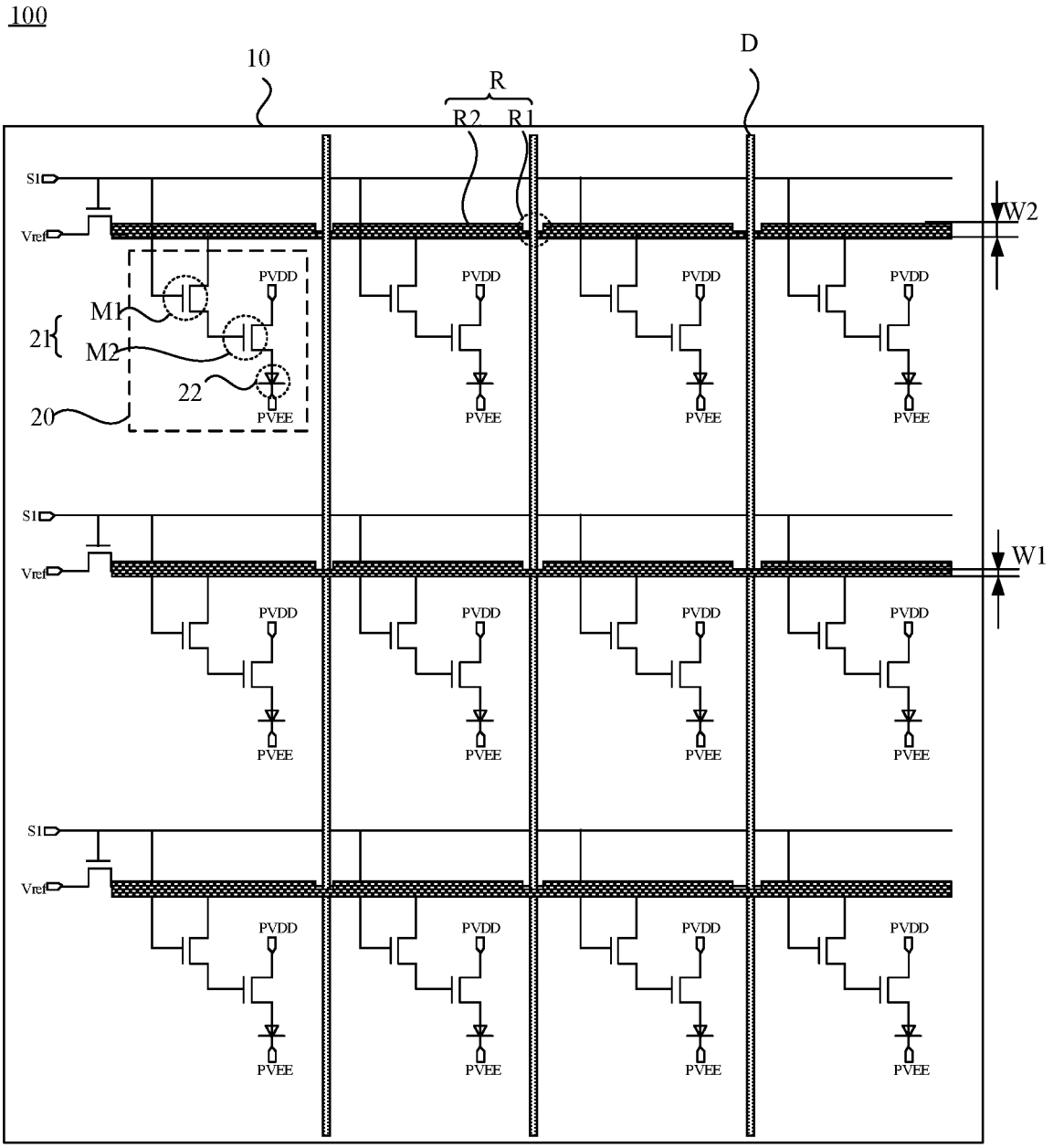
FIG. 13 is a schematic circuit diagram of yet another display panel according to an embodiment of the present disclosure.
Figure 14:
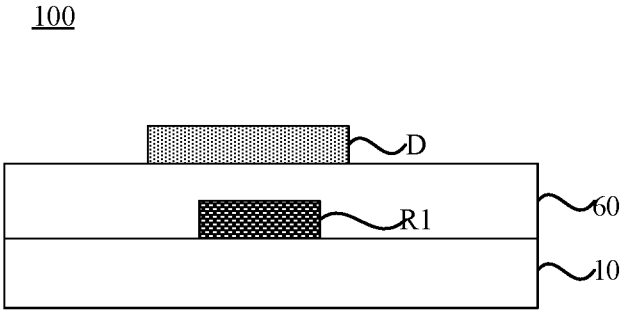
FIG. 14 is a schematic cross sectional view of a film structure of a display panel according to an embodiment of the present disclosure.

FIG. 13 is a schematic circuit diagram of another display panel according to yet another embodiment of the present disclosure, and FIG. 14 is a schematic cross sectional view of a film layer of a display panel according to an embodiment of the present disclosure. As shown in FIGS. 13 and 14, the display panel 100 further includes multiple data lines D extending in the column direction and multiple initialization signal lines R extending in the row direction; the data lines D and the initialization signal lines R are located in different layers. The initialization signal line R includes a first subsection R1 and a second subsection R2, a perpendicular projection of the first subsection R1 on a plane of the top surface of the substrate 10 overlaps with a perpendicular projection of the data line D on the plane of the top surface of the substrate 10; where the width W1 of the first subsection R1 is less than the width W2 of the second division R2, and the width is the width in the column direction.

Specifically, considering that the voltage of the second electrode of the initialization crystal M1 is suspended, since the second electrode of the initialization transistor M1 overlaps with the data line D, that is, a smaller parasitic capacitance exists when the potential of the second electrode of the initialization transistor M1 overlaps the data signal Vdata transferred in the data line D, so that the voltage of the second electrode of the initialization transistor M1 changes, which causes the voltage of the second electrode of the initialization transistor M1 to change. Therefore, in this embodiment, the width of the first subsection R1 overlapping with the perpendicular projection of the data line D on the plane of the top surface of the substrate 10 is reduced, the relative area of the data line D and the initialization signal line R is reduced, the parasitic capacitance between the data line D and the initialization signal line R is reduced, and the influence of the data signal Vdata in the data line D on the second electrode of the initialization transistor M1 is avoided.

It should be noted that those skilled in the art can understand that it is convenient to explain the positional relationship between the data line D and the initialization signal line R, FIG. 14 only briefly shows the relative positional relationship between the data line D and the initialization signal line R in the film structure, but in practice the display panel 100 also includes other signal lines and devices, which are not shown here.

In an embodiment, with continued reference to FIGS. 13 and 14, the display panel 100 further includes multiple data lines D extending in the column direction and multiple initialization signal lines R extending in the row direction; the data lines D and the initialization signal lines R are located in different layers; and between the data line D and the initialization signal line R is provided with an insulating layer 60, the thickness of the insulating layer 60 is H, and 500 nm≤H≤800 nm.

Specifically, the thickness of the insulating layer 60 is increased to reduce the parasitic capacitance generated when the potential of the second electrode of the initialization transistor M1 overlaps with the data signal Vdata transferred in the data line D, and further reduce the influence of other signals on the initialization transistor M1 when the second electrode of the initialization transistor M1 is suspended. By setting the thickness of the insulating layer 60 to H, where 500 nm≤H≤800 nm, the parasitic capacitance when the potential of the second electrode of the initialization transistor M1 overlaps with the data signal Vdata transferred in the data line D can be reduced, the influence of other signals on the potential of the second electrode of the initialization transistor M1 is avoided, so the production cost and the manufacturing yield are ensured.

In an embodiment, with continued reference to FIGS. 13 and 14, the display panel 100 further includes multiple data lines D extending in the column direction and multiple initialization signal lines R extending in the row direction;

the data lines D and the initialization signal lines R are located in different layers; and between the data line D and the initialization signal line R is provided with an insulating layer 60, the dielectric constant of the insulating layer 60 is ε, and ε≤4 F/m.

Specifically, the dielectric constant of the insulating layer 60 is set to be less than or equal to 4 F/m, which reduces the parasitic capacitance generated when the potential of the second electrode of the initialization transistor M1 overlaps with the data signal Vdata transferred in the data line D, and avoids the influence of other signals on the potential of the second electrode of the initialization transistor M1.

Figure 15:
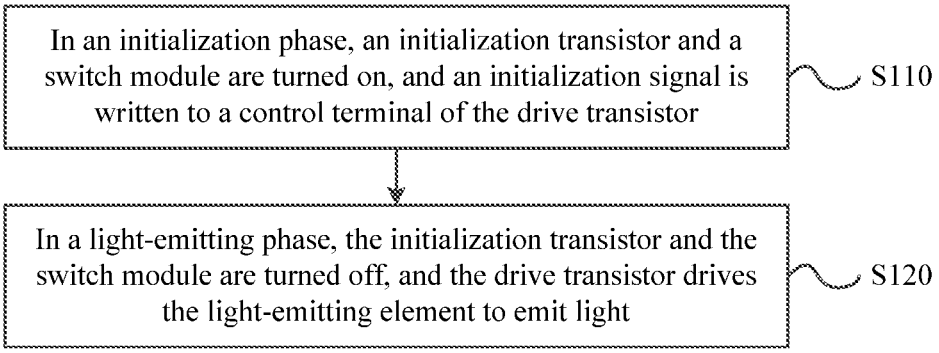
FIG. 15 is a flowchart of a driving method for a display panel according to an embodiment of the present disclosure.

Based on the same inventive concept, an embodiment of the present disclosure also provides a driving method for a display panel, which is applied to the display panel in the above embodiments. FIG. 15 shows the flowchart of the method for driving the display panel according to an embodiment of the present disclosure. As shown in FIG. 15, the pixel driving method includes a step S110 and a step S120.

In S110, in an initialization phase, the initialization transistor and the switch module are turned on, and an initialization signal is written to the control terminal of the drive transistor.

In S120, in a light-emitting phase, the initialization transistor and the switch module are turned off, and the drive transistor drives the light-emitting element to emit light.

Exemplarily, when the driving method for a display panel provided in the embodiment of the present disclosure is used in the display panel shown in FIG. 2, as shown in FIG. 2, in the initialization phase, the switch module 30 and the initialization transistor M1 are turned on, and the initialization transistor M1 provides the initialization signal Vref transferred by the switch module 30 to the gate electrode of the drive transistor M2 to initialize the drive transistor M2. Therefore, the fact that the display effect of the next frame is affected by the potential of the gate electrode of the drive transistor M2 caused by the data signal of the previous frame for light-emitting display is avoided. In a light-emitting phase, the switch module 30 and the initialization transistor M1 are turned off, and a drive current generated by the drive transistor M2 flows into the light-emitting element 22, and the light-emitting element 22 emits light in response to the drive current. The potential difference between the first electrode of the initialization transistor M1 and the second electrode of the initialization transistor M1 changes from V1=Vdata−Vth−Vref in the related art to V2=Vdata−Vth−V0, where Vref is negative, for example, −3.5V, V0 is about 0V, and V2<V1, the potential difference between the first electrode of the initialization transistor M1 and the second electrode of the initialization transistor M1 is reduced, and thereby the leakage of the initialization transistor M1 is reduced. In addition, as mentioned above, the unstable of the voltage of the gate electrode of the drive transistor M2 is caused by the continuous leakage of the initialization transistor M1. In the related art, the initialization transistor of each sub-pixel is a leakage path, and multiple sub-pixels have multiple leakage paths. In this embodiment, the initialization transistors M1 of at least two sub-pixels and a switch module 30 together form a leakage path. Compared with the related art, the magnitude order of electric leakage of multiple sub-pixels 20 in the display panel is reduced, the unstable voltage of the gate electrode of the drive transistor M2 due to the leakage of the initialization transistor M1 is further alleviated, and the display effect is improved.

Figure 16:
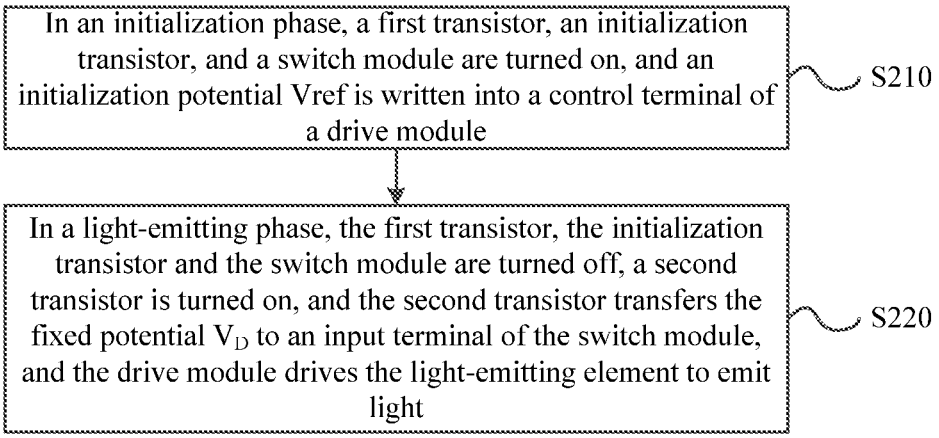
FIG. 16 is a flowchart of another driving method for a display panel according to an embodiment of the present disclosure.

FIG. 16 is a flowchart of another method for driving the display panel according to an embodiment of the present disclosure. The driving method for a display panel is applied to the display panel of FIG. 9 in the above embodiment. As shown in FIG. 9, the display panel further includes: multiple gating modules 40; the gating module 40 includes an inverter 41, a first transistor M3 and a second transistor M4; an output terminal of the inverter 41 is electrically connected to a gate electrode of the second transistor M4; a first electrode of the first transistor M3 is used to obtain an initialization potential Vref; a first electrode of the second transistor M4 is used to obtain a fixed potential $V_D$; a second electrode of the first transistor M3 and a second electrode of the second transistor M4 are electrically connected to input terminals of the switch module 30 respectively; the fixed potential $V_D$ and the initialization potential Vref satisfy: $|V_D-Vdata|<|Vref-Vdata|$; where Vdata is the data signal potential of the sub-pixel 20; as shown in FIG. 16, the driving method includes a step S210 and a step S220.

In S210, in an initialization phase, the first transistor, the initialization transistor, and the switch module are turned on, and the initialization potential Vref is written into a control terminal of the drive module.

In S220, in a light-emitting phase, the first transistor, the initialization transistor and the switch module are turned off, the second transistor is turned on, and the second transistor transfers the fixed potential $V_D$ to an input terminal of the switch module, and the drive module drives the light-emitting element to emit light.

Exemplarily, as shown in FIG. 9, in the initialization phase, the first transistor M3, the switch module 30 and the initialization transistor M1 are turned on, and the initialization transistor M1 provides an initialization signal to the drive transistor M2 to initialize the drive transistor M2. Therefore, the fact that the display effect of the next frame is affected since the potential of the gate electrode of the drive transistor M2 is affected by the data signal of the previous frame for light-emitting display is avoided. In the light-emitting phase, a drive current generated by the drive transistor M2 flows into the light-emitting element 22, and the light-emitting element 22 emits light in response to the drive current. At this time, since the first transistor M3, the initialization transistor M1 and the switch module 30 are turned off, and the second transistor M4 is turned on, the voltage at the input terminal of the switch module 30 changes from Vref to a fixed potential $V_D$, the potential difference between the input terminal and the output terminal of the switch module 30 changes from V0−$V_D$ to V0−Vref, where $|V_D-Vdata|<|Vref-Vdata|$; V0 is the voltage of the second electrode of the initialization transistor M1, namely the voltage of the input terminal of the switch module 30, the voltage value at this time is about 0V. The leakage current of the switch module 30 is reduced, that is, on the basis of the reduced potential difference between the first electrode and the second electrode of the initialization transistor M1, i.e., the reduced leakage current of the initialization transistor M1, the leakage current of the switch module 30 is reduced, and the stability of the voltage of the gate electrode of the drive transistor M2 is further improved, so that the current flowing through the light-emitting element 40 is stable, and the light-emitting element 40 has stable light-emitting brightness.

Figure 17:
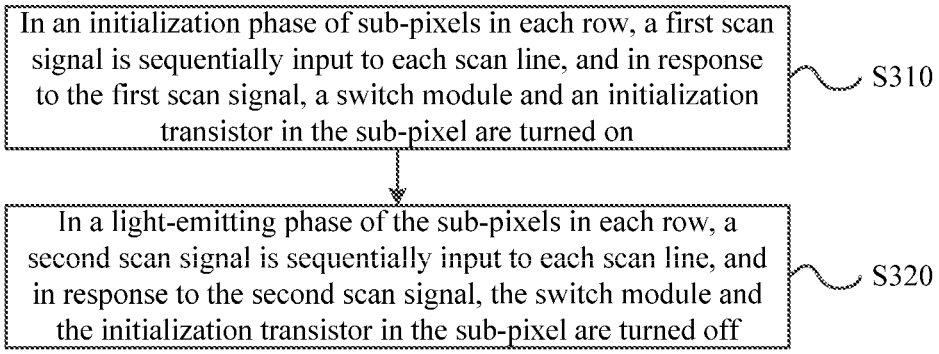
FIG. 17 is a flowchart of yet another driving method for a display panel according to an embodiment of the present disclosure.

FIG. 17 is a flowchart of another driving method for a display panel according to an embodiment of the present disclosure. The display panel further includes multiple scan lines.

In S310, in an initialization phase of sub-pixels in each row, a first scan signal is sequentially input to each scan line, and in response to the first scan signal, the switch module and the initialization transistor in the sub-pixel are turned on.

In S320, in a light-emitting phase of the sub-pixels in each row, a second scan signal is sequentially input to each scan line, and in response to the second scan signal, the switch module and the initialization transistor in the sub-pixel are turned off.

Figure 18:
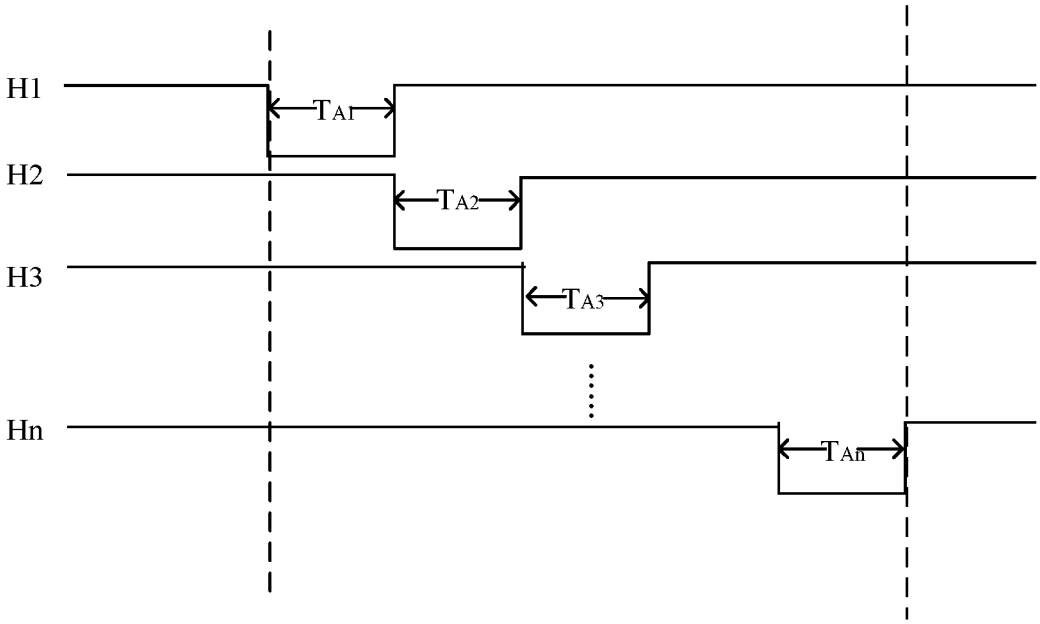
FIG. 18 is a signal timing sequence of a transmission signal on a scan line according to an embodiment of the present disclosure.

Exemplarily, FIG. 18 is a signal timing diagram of a transmission signal on a scan line according to an embodiment of the present disclosure, where H1 to Hn represent the signals input to the scan line corresponding to sub-pixels of the first row to the scan line corresponding to sub-pixels of the last row, the signal includes a first scan signal and a second scan signal, where that the first scan signal is low and the second scan signal is high is taken as an example for description. The switch module and the initialization transistor are turned on in response to a low-level signal, and the switch module and the initialization transistor are turned off in response to a high-level signal.

Specifically, in an initialization phase $T_{A1}$ of the sub-pixels in the first row, when the first scan signal is input to the scan line corresponding to the first row, in response to the first scan signal, the switch module and the initialization transistors of the sub-pixels in the first row are simultaneously turned on to initialize the drive transistors of the sub-pixels in this row through the switch module and the initialization transistors, then the sub-pixels in the first row enter the data writing phase and light-emitting phase in turn, in the data writing phase and the light-emitting phase of the sub-pixels in the first row, a second scan signal is input to the scan line corresponding to the sub-pixels in the first row, and in response to the second scan signal, the switch module in the first row and the initialization transistor in the sub-pixel are simultaneously turned off; in an initialization phase $T_{A2}$ of the sub-pixels in the second row, when the first scan signal is input to the scan line corresponding to the second row, in response to the first scan signal, the switch module in the second row and the initialization transistor in the sub-pixel are simultaneously turned on to initialize the drive transistors of the sub-pixels in this row through the switch module and the initialization transistor, then the sub-pixels in the second row enter the data writing phase and light-emitting phase in turn, in the data writing phase and the light-emitting phase of the sub-pixels in the second row, a second scan signal is input to the scan line corresponding to the sub-pixels in the second row, and in response to the second scan signal, the switch module in the second row and the initialization transistor in the sub-pixel are simultaneously turned off; . . . ; in an initialization phase $T_{An}$ of the sub-pixels in the n-th row, when the first scan signal is input to the scan line corresponding to the n-th row, in response to the first scan signal, the switch module in the n-th row and the initialization transistor in the sub-pixel are simultaneously turned on to initialize the drive transistors of the sub-pixels in this row through the switch module and the initialization transistor, then the sub-pixels in the n-th row enter the data writing phase and light-emitting phase in turn, in the data writing phase and the light-emitting phase of the sub-pixels in the n-th row, a second scan signal is input to the scan line corresponding to the sub-pixels in the n-th row, and in response to the second scan signal, the switch module in the n-th row and the initialization transistor in the sub-pixel are simultaneously turned off. That is, in the initialization phase $T_A$ of sub-pixels of each row, when the first scan signal is sequentially input to each scan line, in response to the first scan signal, for the switch module and the initialization transistor in the sub-pixel in a same row, the switch module and the initialization transistor are simultaneously turned on, the switch modules and the initialization transistors in the sub-pixels in different rows are sequentially turned on according to the first scan signal according to the arrangement of the rows, so as to initialize the drive transistors in the sub-pixels in the row through the switch modules and the initialization transistors in each row. In the light-emitting phase of sub-pixels of each row, when the second scan signal is sequentially input to each scan line, in response to the second scan signal, for the switch module and the initialization transistor in the sub-pixel in the same row, the switch module and the initialization transistor are turned off at the same time, the switch modules and the initialization transistors in the sub-pixels in different rows are sequentially turned off according to the second scan signal according to the row arrangement. At this time, due to the presence of the switch module, the voltage of the second electrode of the initialization transistor is suspended, the potential difference between the first electrode of the initialization transistor and the second electrode of the initialization transistor is reduced, and thereby the leakage of the initialization transistor is reduced. The initialization transistors of at least two sub-pixels and a switch module together form a leakage path, the magnitude order of electric leakage of multiple sub-pixels in the display panel is reduced, the unstable voltage of the gate electrode of the drive transistor due to the leakage of the initialization transistor M1 is further alleviated, and the display effect is improved.

Based on the same inventive concept, an embodiment of the present disclosure also provides a display device, including the display panel of any embodiment of the present disclosure.

Figure 19:
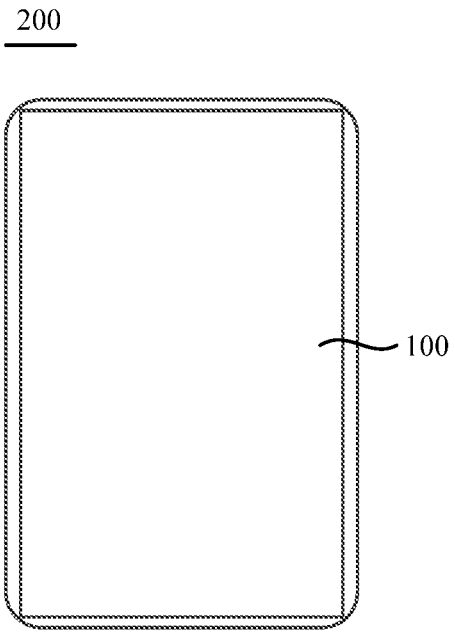
FIG. 19 is a schematic diagram of a display device.

Exemplarily, FIG. 19 is a schematic structural diagram of a display device according to an embodiment of the present disclosure. As shown in FIG. 19, the display device 200 according to the embodiment of the present disclosure includes the display panel 100 in the above embodiment, so the display device 200 provided by the embodiment of the present disclosure also has the beneficial effects described in the above embodiments, which will not be repeated here. The display device 200 may be, for example, any electronic device with a display function such as a touch screen, a mobile phone, a tablet computer, a notebook computer, or a television.

It is to be noted that the above are merely illustrative embodiments of the present disclosure and the technical principles used therein. It will be understood by those skilled in the art that the present disclosure is not limited to the specific embodiments described herein. Those skilled in the art may make various apparent modifications, adaptations and substitutions without departing from the scope of the present disclosure. Therefore, while the present disclosure has been described in detail through the above-mentioned embodiments, the present disclosure is not limited to the above-mentioned embodiments and may include more other equivalent embodiments without departing from the concept of the present disclosure. The scope of the present disclosure is determined by the scope of the appended claims

What is claimed is:

1. A display panel, comprising:

a substrate;

a plurality of sub-pixels located on one side of the substrate, wherein the plurality of sub-pixels is arranged in an array; and at least one switch module;

wherein each of the plurality of sub-pixels comprises a pixel drive circuit and a light-emitting element, wherein the pixel drive circuit comprises an initialization transistor and a drive transistor, wherein the initialization transistor and the drive transistor each comprise a first electrode, a second electrode, and a gate electrode;

wherein the first electrode of the initialization transistor is electrically connected to the gate electrode of the drive transistor, and the drive transistor provides a drive current to the light-emitting element; and wherein the second electrodes of the initialization transistors of at least two of the plurality of sub-pixels are connected to an output terminal of a same switch module of the at least one switch module;

wherein an input terminal of each of the at least one switch module is electrically connected to an initialization signal terminal; and wherein each of the at least one switch module is used to transfer an initialization signal to the second electrode of the initialization transistor;

wherein for the switch module of the at least one switch module and the initialization transistors of the sub-pixels connected to the switch module, gate electrodes of the initialization transistors of the sub-pixels and a control terminal of the switch module are electrically connected to a same scan line.

2. The display panel of claim 1, wherein second electrodes of initialization transistors of sub-pixels in each row are connected to an output terminal of a same switch module of the at least one switch module.

3. The display panel of claim 2, further comprising:

a plurality of scan lines;

a first scan drive circuit; and a second scan drive circuit;

wherein each signal output terminal of the first scan drive circuit is connected to each signal output terminal of the second scan drive circuit through one of the plurality of scan lines;

wherein the first scan drive circuit and the second scan drive circuit are electrically connected to a same scan line of the plurality of scan lines synchronously and output a scan signal to said same scan line through the signal output terminals;

wherein each of the at least one switch module comprises a first switch unit and a second switch unit;

wherein a number of the plurality of sub-pixels in each row is M;

wherein an output terminal of the first switch unit is electrically connected to second electrodes of the initialization transistors of N sub-pixels of the sub-pixels in each row;

wherein an output terminal of the second switch unit is electrically connected to second electrodes of the initialization transistors of remaining (M−N) sub-pixels of the sub-pixels in the each row;

wherein for the first switch unit and the initialization transistor of each of the N sub-pixels connected to the first switch unit, a control terminal of the first switch units and gate electrode of the initialization transistor of each of the N sub-pixels are electrically connected to a same scan line of the plurality of scan lines;

wherein for the second switch unit and the initialization transistor of each of remaining (M−N) sub-pixels connected to the second switch unit, a control terminal of the second switch unit and gate electrode of the initialization transistor of each of the (M−N) sub-pixels are electrically connected to the same scan line of the plurality of scan lines; and wherein an output terminal of each of the at least one switch module comprises the output terminal of the first switch unit and the output terminal of the second switch unit; and wherein M and N are both positive integers, and N is smaller than M.

4. The display panel of claim 1, wherein, for a switch module of the at least one switch module and the initialization transistor of the sub-pixels connected to the switch module, an off state of the switch module and an off state of the initialization transistor of said sub-pixel overlap in time.

5. The display panel of claim 4, further comprising:

a plurality of scan lines and a first scan drive circuit;

wherein a plurality of signal output terminals of the first scan drive circuit each is electrically connected to one of the plurality of scan lines in one-to-one correspondence; and wherein the first scan drive circuit outputs a scan signal to one of the plurality of scan lines through a corresponding one of the plurality of signal output terminals.

6. The display panel of claim 4, further comprising:

a plurality of scan lines;

a first scan drive circuit; and a second scan drive circuit;

wherein each signal output terminal of the first scan drive circuit is connected to each signal output terminal of the second scan drive circuit through one of the plurality of scan lines;

wherein the first scan drive circuit and the second scan drive circuit electrically are connected to a same scan line of the plurality of scan lines synchronously and output a scan signal to the same scan line through the signal output terminals.

7. The display panel of claim 1, further comprising:

at least one gating module, wherein each of the at least one gating module comprises an inverter, a first transistor and a second transistor; an output terminal of the inverter, electrically connected to a gate electrode of the second transistor;

a first electrode of the first transistor, used to obtain an initialization potential Vref;

a first electrode of the second transistor used to obtain a fixed potential $V_D$; and a second electrode of the first transistor and a second electrode of the second transistor, electrically connected to an input terminal of one of the at least one switch module respectively;

wherein the fixed potential $V_D$ and the initialization potential Vref satisfy:

$$|V_D - V_{data}| < |V\text{ref} - V\text{data}|;$$

wherein the Vdata is a data signal potential of the plurality of sub-pixels; a signal received at a gate electrode of the first transistor is the same as a signal at an input terminal of the inverter.

8. The display panel of claim 7, wherein the fixed potential $V_D$ is a ground potential.

9. The display panel of claim 1, wherein the pixel drive circuit further comprises a data write transistor, a threshold compensation transistor, a light-emitting control module, a storage capacitor, and a reset transistor;

wherein the data write transistor transmits data signals;

wherein the threshold compensation transistor compensates a gate electrode of the drive transistor with a threshold voltage of the drive transistor;

wherein the light-emitting control module controls the drive transistor to generate a drive current to flow into the light-emitting element;

wherein the reset transistor provides an initialization signal to an anode of the light-emitting element;

wherein the light-emitting control module comprises a first light-emitting control transistor and a second light-emitting control transistor;

wherein a gate electrode of the data write transistor is electrically connected to a second scan signal terminal, a first electrode of the data write transistor is electrically connected to a data signal terminal, and a second electrode of the data write transistor is electrically connected to a first electrode of the drive transistor;

wherein a gate electrode of the threshold compensation transistor is electrically connected to the second scan signal terminal, wherein a first electrode of the threshold compensation transistor is electrically connected to a second electrode of the drive transistor, and wherein a second electrode of the threshold compensation transistor is electrically connected to the gate electrode of the drive transistor;

wherein a gate electrode of the first light-emitting control transistor is electrically connected to a light-emitting control signal terminal, a first electrode of the first light-emitting control transistor is electrically connected to a first power supply signal terminal, and a second electrode of the first light-emitting control transistor is electrically connected to the first electrode of the drive transistor;

wherein a gate electrode of the second light-emitting control transistor is electrically connected to the light-emitting control signal terminal, a first electrode of the second light-emitting control transistor is electrically connected to the second electrode of the drive transistor and a second electrode of the second light-emitting control transistor is electrically connected to the anode of the light-emitting element; and wherein a cathode of the light-emitting element is electrically connected to a second power signal terminal.

10. The display panel of claim 1, further comprising:

a plurality of data lines extending in a column direction and a plurality of initialization signal lines extending in a row direction;

wherein the plurality of data lines and the plurality of initialization signal lines are located in different layers;

wherein each of the plurality of initialization signal lines comprises a first subsection and a second subsection, a perpendicular projection of the first subsection on a plane of top surface of the substrate is located overlaps with a perpendicular projection of one of the plurality of data lines on the plane where the top surface of the substrate is located; and wherein a width of the first subsection is smaller than a width of the second subsection, wherein the width is in the column direction.

11. The display panel of claim 1, further comprising a plurality of data lines extending in a column direction and a plurality of initialization signal lines extending in a row direction, wherein the plurality of data lines and the plurality of initialization signal lines are located in different layers; and wherein an insulating layer is provided between the plurality of data lines and the plurality of initialization signal lines, and a thickness of the insulating layer is H, 500 nm≤H≤800 nm.

12. The display panel of claim 1, further comprising a plurality of data lines extending in a column direction and a plurality of initialization signal lines extending in a row direction, wherein the plurality of data lines and the plurality of initialization signal lines are located in different layers; and wherein an insulating layer is provided between the plurality of data lines and the plurality of initialization signal lines, and wherein a dielectric constant of the insulating layer is ε, ε≤4 F/m.

13. The display panel of claim 1, wherein each of the at least one switch module comprises a third transistor, wherein a first electrode of the third transistor is electrically connected to the initialization signal terminal, wherein a second electrode of the third transistor is electrically connected to the second electrodes of the initialization transistors of at least two of the plurality of sub-pixels; and wherein a gate electrode of the third transistor is used to obtain a switch control signal.

14. A driving method applied to a display panel, wherein the display panel comprises: a substrate;

a plurality of sub-pixels located on one side of the substrate; wherein the plurality of sub-pixels is arranged in an array, wherein each of the plurality of sub-pixels comprises a pixel drive circuit and a light-emitting element; and at least one switch module;

wherein the pixel drive circuit comprises an initialization transistor and a drive transistor, wherein the initialization transistor and the drive transistor each comprise a first electrode, a second electrode, and a gate electrode;

wherein the first electrode of the initialization transistor is electrically connected to the gate electrode of the drive transistor, and the drive transistor is used to provide a drive current to the light-emitting element; and wherein the second electrodes of the initialization transistors of at least two of the plurality of sub-pixels are connected to an output terminal of a same switch module of the at least one switch module;

wherein an input terminal of each of the at least one switch module is electrically connected to an initialization signal terminal;

wherein each of the at least one switch module transfers an initialization signal to the second electrode of the initialization transistor;

wherein for the switch module of the at least one switch module and the initialization transistors of the sub-pixels connected to the switch module, gate electrodes of the initialization transistors of the sub-pixels and a control terminal of the switch module are electrically connected to a same scan line;

wherein the method applied to the display panel comprises:

in an initialization phase; turning on the initialization transistor and the at least one switch module, and writing an initialization signal to the gate electrode of the drive transistor; and in a light-emitting phase: turning off the initialization transistor and the at least one switch module, and driving, by the drive transistor, the light-emitting element to emit light.

15. The driving method of claim 14, wherein the display panel further comprises:

a plurality of gating modules, wherein each of the plurality of gating modules comprises an inverter, a first transistor, and a second transistor;

wherein an output terminal of the inverter is electrically connected to a gate of the second transistor; wherein a first electrode of the first transistor obtains an initialization potential Vref; wherein a first electrode of the second transistor obtains a fixed potential $V_D$; wherein a second electrode of the first transistor and a second electrode of the second transistor are electrically connected to an input terminal of one of the at least one switch module respectively; wherein the fixed potential $V_D$ and the initialization potential Vref satisfy: $|V_D - V_{data}| < |Vref - Vdata|$; wherein the Vdata is a data signal potential of the plurality of sub-pixels;

wherein the driving method further comprises:

in the initialization phase: turning on the first transistor, the initialization transistor, and the at least one switch module, and writing the initialization potential $V_{REF}$ into the gate electrode of the drive transistor; and in the light-emitting phase: turning off the first transistor, the initialization transistor and the at least one switch module, turning on the second transistor, transferring, by the second transistor, the fixed potential $V_D$ to an input terminal of the at least one switch module, and driving, by the drive transistor, the light-emitting element to emit light.

16. The driving method of claim 14, wherein the display panel further comprises a plurality of scan lines;

wherein the driving method further comprises:

in an initialization phase of sub-pixels of the plurality of sub-pixels in each row; inputting sequentially a first scan signal to each scan line of the plurality of scan lines, and turning on the at least one switch module and the initialization transistor in response to the first scan signal; and in a light-emitting phase of the sub-pixels of the plurality of sub-pixels in each row; inputting sequentially a second scan signal to each scan line of the plurality of scan lines, and turning off the at least one switch module and the initialization transistor in response to the second scan signal.

17. A display device, comprising a display panel, wherein the display panel comprises:

a substrate;

a plurality of sub-pixels located on one side of the substrate, wherein the plurality of sub-pixels is arranged in an array; and at least one switch module;

wherein each of the plurality of sub-pixels comprises a pixel drive circuit and a light-emitting element, wherein the pixel drive circuit comprises an initialization transistor and a drive transistor, wherein the initialization transistor and the drive transistor each comprise a first electrode, a second electrode, and a gate electrode;

wherein the first electrode of the initialization transistor is electrically connected to the gate electrode of the drive transistor, and the drive transistor provides a drive current to the light-emitting element; and wherein the second electrodes of the initialization transistors of at least two of the plurality of sub-pixels are connected to an output terminal of a same switch module of the at least one switch module; wherein an input terminal of each of the at least one switch module is electrically connected to an initialization signal terminal; wherein each of the at least one switch module transfers an initialization signal to the second electrode of the initialization transistor;

wherein for the switch module of the at least one switch module and the initialization transistors of the sub-pixels connected to the switch module, gate electrodes of the initialization transistors of the sub-pixels and a control terminal of the switch module are electrically connected to a same scan line.

* * * * *